US011905056B2

(12) United States Patent
Showman et al.

(10) Patent No.: US 11,905,056 B2
(45) Date of Patent: Feb. 20, 2024

(54) CARTONING MACHINE FOR MULTIPLE, DIFFERENT CARTON CONFIGURATIONS AND METHOD OF USE

(71) Applicant: Intertape Polymer Corp., Sarasota, FL (US)

(72) Inventors: David Showman, Schaumburg, IL (US); Bojan Jovanovic, Schaumburg, IL (US)

(73) Assignee: INTERTAPE POLYMER CORP., Sarasota, FL (US)

( * ) Notice: Subject to any disclaimer, the term of this patent is extended or adjusted under 35 U.S.C. 154(b) by 0 days.

(21) Appl. No.: 17/032,678

(22) Filed: Sep. 25, 2020

(65) Prior Publication Data

US 2021/0094716 A1 Apr. 1, 2021

Related U.S. Application Data

(60) Provisional application No. 62/907,317, filed on Sep. 27, 2019.

(51) Int. Cl.
*B65B 43/44* (2006.01)
*B65B 43/26* (2006.01)
(Continued)

(52) U.S. Cl.
CPC ..... *B65B 43/44* (2013.01); *B65B 43/265* (2013.01); *B65B 43/46* (2013.01); *B65B 43/50* (2013.01)

(58) Field of Classification Search
CPC ..... B31B 50/005; B31B 50/066; B31B 50/26; B31B 50/07; B31B 50/622; B31B 50/006;
(Continued)

(56) References Cited

U.S. PATENT DOCUMENTS 1,625,057 A * 4/1927 Schnur ..... B65B 43/145 271/12
5,002,267 A * 3/1991 Brecy ..... B65H 3/44 271/9.08
(Continued)

FOREIGN PATENT DOCUMENTS

CN 108945614 A 12/2018
DE 102011001127 A1 9/2012
(Continued)

OTHER PUBLICATIONS

European Patent Office; International Search Report and Written Opinion for International Patent Application No. PCT/US2020/052762 dated Jan. 20, 2021, 39 Pages.
(Continued)

*Primary Examiner* — Thomas M Wittenschlaeger
(74) *Attorney, Agent, or Firm* — Jeffrey R. Gray; Moore & Van Allen PLLC

(57) ABSTRACT

A cartoning machine including a carton supply station (e.g., a rotary carton supply station, a linear carton supply station, a non-linear carton supply station, or the like) and a handling station operatively coupled to the carton supply station. The carton supply station provides, on a selective basis, cartons, such as carton blanks, pre-formed cartons, or the like. The carton supply station of the cartoning machine provides for movement of magazines with respect to a robot in the handling station that may have a distal end secured in a stationary and fixed location. As such, different magazines with dissimilar cartons may be moved to a picking location adjacent the robot, as dissimilar cartons are required. Further, the cartons within the magazines may be moved to a pre-determined pick-up location such that the robot is repeatably picking a carton from the pre-determine pick-up location.

18 Claims, 18 Drawing Sheets

(51) Int. Cl.
*B65B 43/46* (2006.01)
*B65B 43/50* (2006.01)

(58) Field of Classification Search
CPC ..... B31B 50/802; B65B 43/305; B65B 43/50; B65B 43/44; B65B 43/46; B65B 43/265; B65H 2405/36; B65H 2405/352; B65H 2405/33; B65H 2701/1766; B65H 2701/1764; B65H 3/44; B65H 2555/31
See application file for complete search history.

(56) References Cited

U.S. PATENT DOCUMENTS 5,354,170 A * 10/1994 Schweingruber ..... B65H 33/16 414/790
5,515,664 A 5/1996 Tanaka et al.
5,536,231 A * 7/1996 Nilsson ..... B31B 50/00 493/315
5,653,087 A * 8/1997 Spada ..... B25J 15/08 242/559.2
5,911,252 A * 6/1999 Cassel ..... B65B 3/003 141/234
7,569,009 B2 * 8/2009 Monti ..... B65H 1/30 493/126
8,056,200 B2 * 11/2011 Hesse ..... B23Q 39/046 29/33 P
8,083,659 B2 * 12/2011 Monti ..... B65B 43/265 493/163
8,621,831 B2 * 1/2014 Moylan ..... B65B 39/06 53/504
10,137,656 B2 * 11/2018 Lundgren ..... B31B 50/00
10,173,329 B2 * 1/2019 Christiansen ..... B65H 31/3045
10,279,941 B2 * 5/2019 Hansen ..... B31B 50/78
10,556,713 B2 * 2/2020 Langen ..... B65B 43/265
10,703,063 B2 * 7/2020 Heath ..... B31B 50/804
2006/0117714 A1 * 6/2006 Draghetti ..... B65B 43/265 53/458
2007/0072755 A1 * 3/2007 Monti ..... B31B 50/804 493/125
2007/0132170 A1 * 6/2007 Butler, Jr. ..... B65H 5/26 271/9.01
2007/0245689 A1 10/2007 Lubezny
2010/0170202 A1 * 7/2010 Bray ..... B65B 19/02 53/236
2014/0157725 A1 * 6/2014 Lena ..... B65B 43/52 53/444
2014/0179501 A1 * 6/2014 Akama ..... B25J 9/0096 493/162
2016/0121633 A1 * 5/2016 Tanisaki ..... G03G 15/6594 271/9.01
2018/0043650 A1 2/2018 Heath et al.
2018/0222608 A1 8/2018 Hutter et al.
2021/0237385 A1 * 8/2021 Fridolfsson ..... B65B 43/18

FOREIGN PATENT DOCUMENTS

GB 1493917 A 11/1977
JP 2001122460 A 5/2001
JP 2019064592 A * 4/2019 ..... B65B 5/06

OTHER PUBLICATIONS

International Bureau of WIPO; International Preliminary Report on Patentability for International Application No. PCT/US2020/052762 dated Apr. 7, 2022, 7 Pages.

* cited by examiner

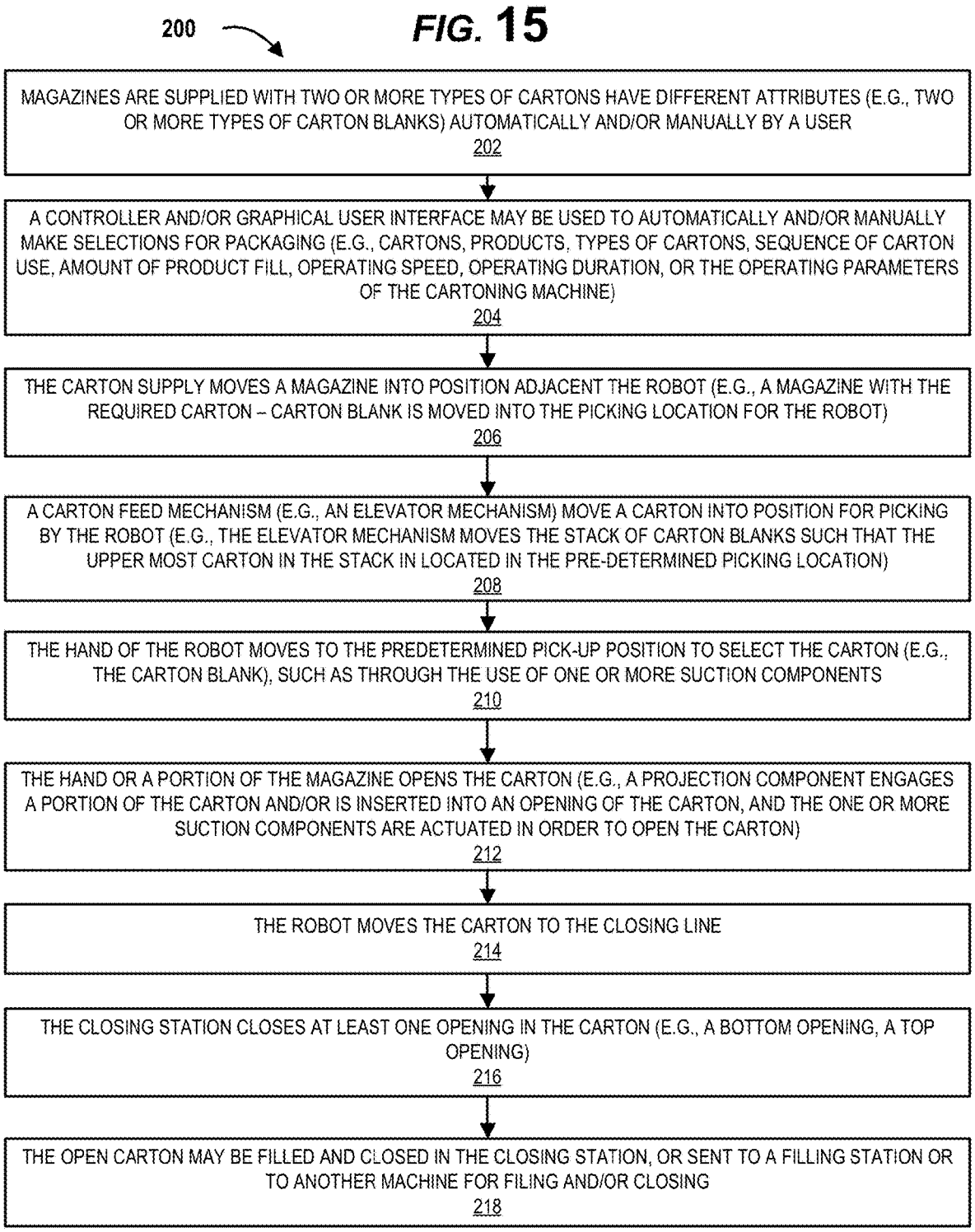
200
FIG. 15
MAGAZINES ARE SUPPLIED WITH TWO OR MORE TYPES OF CARTONS HAVE DIFFERENT ATTRIBUTES (E.G., TWO OR MORE TYPES OF CARTON BLANKS) AUTOMATICALLY AND/OR MANUALLY BY A USER
202
A CONTROLLER AND/OR GRAPHICAL USER INTERFACE MAY BE USED TO AUTOMATICALLY AND/OR MANUALLY MAKE SELECTIONS FOR PACKAGING (E.G., CARTONS, PRODUCTS, TYPES OF CARTONS, SEQUENCE OF CARTON USE, AMOUNT OF PRODUCT FILL, OPERATING SPEED, OPERATING DURATION, OR THE OPERATING PARAMETERS OF THE CARTONING MACHINE)
204
THE CARTON SUPPLY MOVES A MAGAZINE INTO POSITION ADJACENT THE ROBOT (E.G., A MAGAZINE WITH THE REQUIRED CARTON – CARTON BLANK IS MOVED INTO THE PICKING LOCATION FOR THE ROBOT)
206
A CARTON FEED MECHANISM (E.G., AN ELEVATOR MECHANISM) MOVE A CARTON INTO POSITION FOR PICKING BY THE ROBOT (E.G., THE ELEVATOR MECHANISM MOVES THE STACK OF CARTON BLANKS SUCH THAT THE UPPER MOST CARTON IN THE STACK IN LOCATED IN THE PRE-DETERMINED PICKING LOCATION)
208
THE HAND OF THE ROBOT MOVES TO THE PREDETERMINED PICK-UP POSITION TO SELECT THE CARTON (E.G., THE CARTON BLANK), SUCH AS THROUGH THE USE OF ONE OR MORE SUCTION COMPONENTS
210
THE HAND OR A PORTION OF THE MAGAZINE OPENS THE CARTON (E.G., A PROJECTION COMPONENT ENGAGES A PORTION OF THE CARTON AND/OR IS INSERTED INTO AN OPENING OF THE CARTON, AND THE ONE OR MORE SUCTION COMPONENTS ARE ACTUATED IN ORDER TO OPEN THE CARTON)
212
THE ROBOT MOVES THE CARTON TO THE CLOSING LINE
214
THE CLOSING STATION CLOSES AT LEAST ONE OPENING IN THE CARTON (E.G., A BOTTOM OPENING, A TOP OPENING)
216
THE OPEN CARTON MAY BE FILLED AND CLOSED IN THE CLOSING STATION, OR SENT TO A FILLING STATION OR TO ANOTHER MACHINE FOR FILING AND/OR CLOSING
218

CARTONING MACHINE FOR MULTIPLE, DIFFERENT CARTON CONFIGURATIONS AND METHOD OF USE

CROSS REFERENCE AND PRIORITY CLAIM UNDER 35 U.S.C. § 119

The present Application for a Patent claims priority to U.S. Provisional Patent Application Ser. No. 62/907,317 entitled "Cartoning Machine for Multiple, Different Carton Configurations and Method of Use," filed on Sep. 27, 2019, and assigned to the assignees hereof and hereby expressly incorporated by reference herein.

FIELD

The present disclosure relates generally to a packaging machine. More specifically, a cartoning machine that accurately and efficiently selects different sized and/or configured cartons, such as carton blanks, from an inventory of cartons.

BACKGROUND

A cartoning machine is a type of packaging machine that uses a robot and a control system to select cartons that are filled with a product, such as a food, supplement, pharmaceutical, consumer item, or other goods. A conventional machine includes a magazine station that is positioned within a staging area or holding area that stores flat carton blanks, which are of the same size and/or configuration. The conventional cartoning machine selects a carton blank from a stack of carton blanks (e.g., in a collapsed state, such as in a flat state, or the like), whereupon the machine opens the carton blank to form or erect a carton. This carton formation process can include assembling a portion of the carton—for example, the bottom or top flaps—to partially erect the carton. Many conventional cartoning machines operate in-line, pulling carton blanks from a single magazine and sending the carton blanks through opening and flap folding sections of the machine. These machines can only handle processing of a single configuration of a carton blank at a time and must be re-arranged off-line to handle a different configuration of a carton blank for cartoning. This process is inherently inefficient and time-consuming.

BRIEF SUMMARY

Embodiments of the invention comprise an improved cartoning machine. The cartoning machine includes a carton supply station (e.g., a rotary carton supply station, a linear carton supply station, a non-linear carton supply station, or the like) and a handling station operatively coupled to the carton supply station. The carton supply station provides, on a selective basis, cartons, such as carton blanks, pre-formed cartons, or the like. In the case of carton blanks, the carton blanks may be opened within the handling station. A carton blank is a term for when the carton is in a flat or blank state prior to be erected into a configuration that can hold or retain contents. In some embodiments, the carton blank may be required to be folded into a shape for packaging, or in other embodiments the carton blank may be flexible such that it can be opened by simply expanding an opening of the carton (e.g., expandable paper, plastic, or the like). With respect to the pre-formed cartons, the cartoning machine may be utilized with cartons (e.g., stacked plastic, cardboard, paper, or other like cartons) that do not require the need for bending for forming the pre-formed carton into and erected carton. The carton supply station of the cartoning machine described and illustrated herein provides for movement of magazines with respect to a robot in the handling station that has a distal end secured in a stationary and fixed location. As such, different magazines with dissimilar cartons may be moved to a picking location adjacent the robot, as dissimilar cartons are required. Further, the cartons within the magazines may be moved to a pre-determined pick-up location such that the robot is repeatably picking a carton from the pre-determined pick-up location.

Embodiments of the invention include a cartoning apparatus comprising a handling station having a robot, and a carton supply station having a plurality of magazines for holding cartons. The plurality of magazines have a first magazine configured to hold a plurality of first cartons and a second magazine configured to hold a plurality of second cartons. The plurality of magazines are movable with respect to the robot. The robot is configured to pick the cartons from the plurality of magazines.

In further accord with embodiments, the cartons held in the plurality of magazines comprise a plurality of carton blanks.

In other embodiments, the cartons held in the plurality of magazines comprise a plurality of pre-formed cartons.

In still other embodiments, the carton supply station has a rotating support, wherein the plurality of magazines are operatively coupled to the rotating support, and wherein the plurality of magazines rotate with respect the robot.

In yet other embodiments, the handling station is located adjacent the carton supply station, and the first magazine of the plurality of magazines of the carton supply station is located in a picking location adjacent the robot of the handling station.

In other embodiments, the handling station further comprises a carton feeder mechanism. The carton feeder mechanism is configured to move a carton in the first magazine to a pre-determined pick-up position for the robot to pick the carton from the first magazine.

In further accord with embodiments, the carton feeder mechanism comprises an elevator mechanism. The elevator elevates the plurality of first cartons in the first magazine such that the carton moved to the pre-determined pick-up position is an upper most carton in the first magazine.

In other embodiments the carton feeder mechanism comprises a pick-up position sensor. The carton feeder mechanism moves the carton to the pre-determined pick-up position based on feedback from the pick-up position sensor.

In still other embodiments, the robot is configured to pick a carton using one or more suction devices.

In yet other embodiments, the robot is configured to open a carton for receipt of a product.

In other embodiments, the carton is a carton blank and the robot comprises a first engaging component and a second engaging component. The first engaging component engages the carton blank on a first portion and the second engaging component engages the carton blank on a second portion. The first engaging component moves with respect to the second engaging component to open the carton along a fold line between the first portion and the second portion.

In further accord with embodiments, the handling station or the carton supply station further comprises a projection component. The projection component configured for positioning adjacent to the fold line and aids in folding the carton around the fold line when the first engaging component moves with respect to the second engaging component.

In other embodiments, the cartoning apparatus further comprises a closing station arranged adjacent to the handling station. The robot is configured to move the carton to the closing station, and the closing station is configured to close a portion of carton.

In still other embodiments, the cartoning apparatus further comprises a product supply station. A first carton is utilized from the first magazine when a first product amount is selected for packaging and a second carton is utilized from the second magazine when a second product amount is selected.

In yet other embodiments, the cartoning apparatus further comprises two or more product supply stations. A first carton is utilized from the first magazine when a first product from a first product supply is selected for packaging and a second carton is utilized from the second magazine when a second product from a second product supply is selected.

In other embodiments, the cartoning apparatus further comprises a controller operatively coupled to the handling station and the carton supply station. The controller is configured to operate the handling station and the carton supply station.

Embodiments of the invention include a method of supplying a carton using a cartoning apparatus. The apparatus comprises a handling station having a robot, and a carton supply station having a plurality of magazines for holding cartons. The method comprises moving a first magazine of the plurality of magazines adjacent to the robot and a second magazine away from the robot. The first magazine is configured to hold a plurality of first cartons and the second magazine is configured to hold a plurality of second cartons, and the plurality of magazines are movable with respect to the robot. The method further comprises moving the robot to pick a carton from the first magazine adjacent to the robot.

In further accord with embodiments, the cartons held in the plurality of magazines comprise a plurality of carton blanks or a plurality of pre-formed cartons.

In other embodiments, the carton supply station comprises a rotating support, and the plurality of magazines are operatively coupled to the rotating support. The plurality of magazines rotate with respect the robot.

In still other embodiments, the handling station further comprises a carton feeder mechanism. The method further comprises moving the carton in the first magazine to a pre-determined pick-up position for the robot to pick the carton from the first magazine.

To the accomplishment the foregoing and the related ends, the one or more embodiments comprise the features hereinafter described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

The following figures (sometimes abbreviated as "Fig." or "Figs." herein) will now be described by way of example, not by way of limitation, in which:

FIG. 15 illustrates a method of selecting, picking, opening, filling, and/or closing a carton, in accordance with embodiments of the present disclosure.

Figure 1:
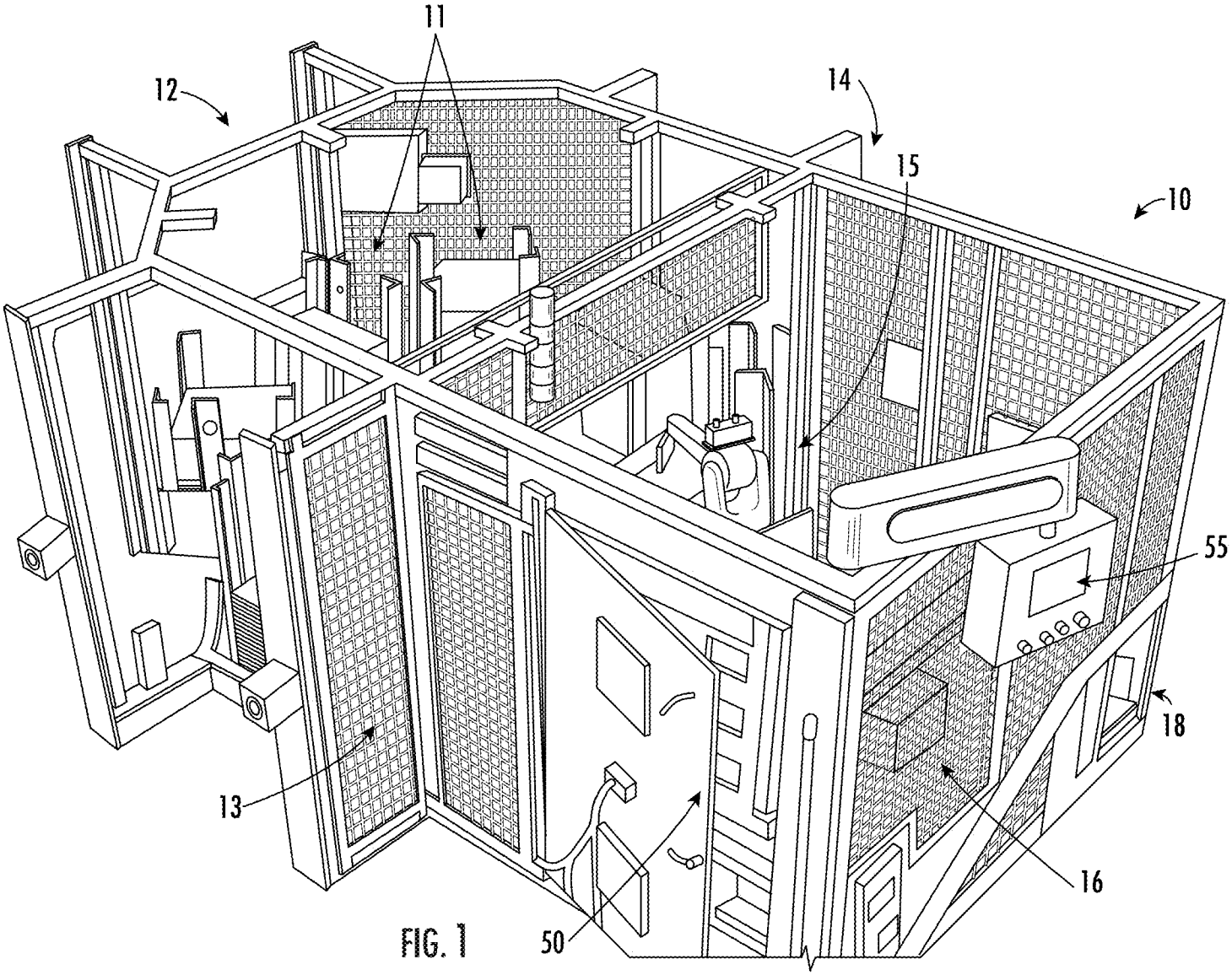
FIG. 1 is a perspective view of a cartoning machine, in accordance with embodiments of the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible to embodiments in many different forms, there is shown in the drawings and will herein be described in detail preferred embodiments of the present disclosure with the understanding that the present disclosure is to be considered as an exemplification of the principles of the present disclosure and is not intended to limit the broad aspect of the present disclosure to the embodiments illustrated.

Figure 2:
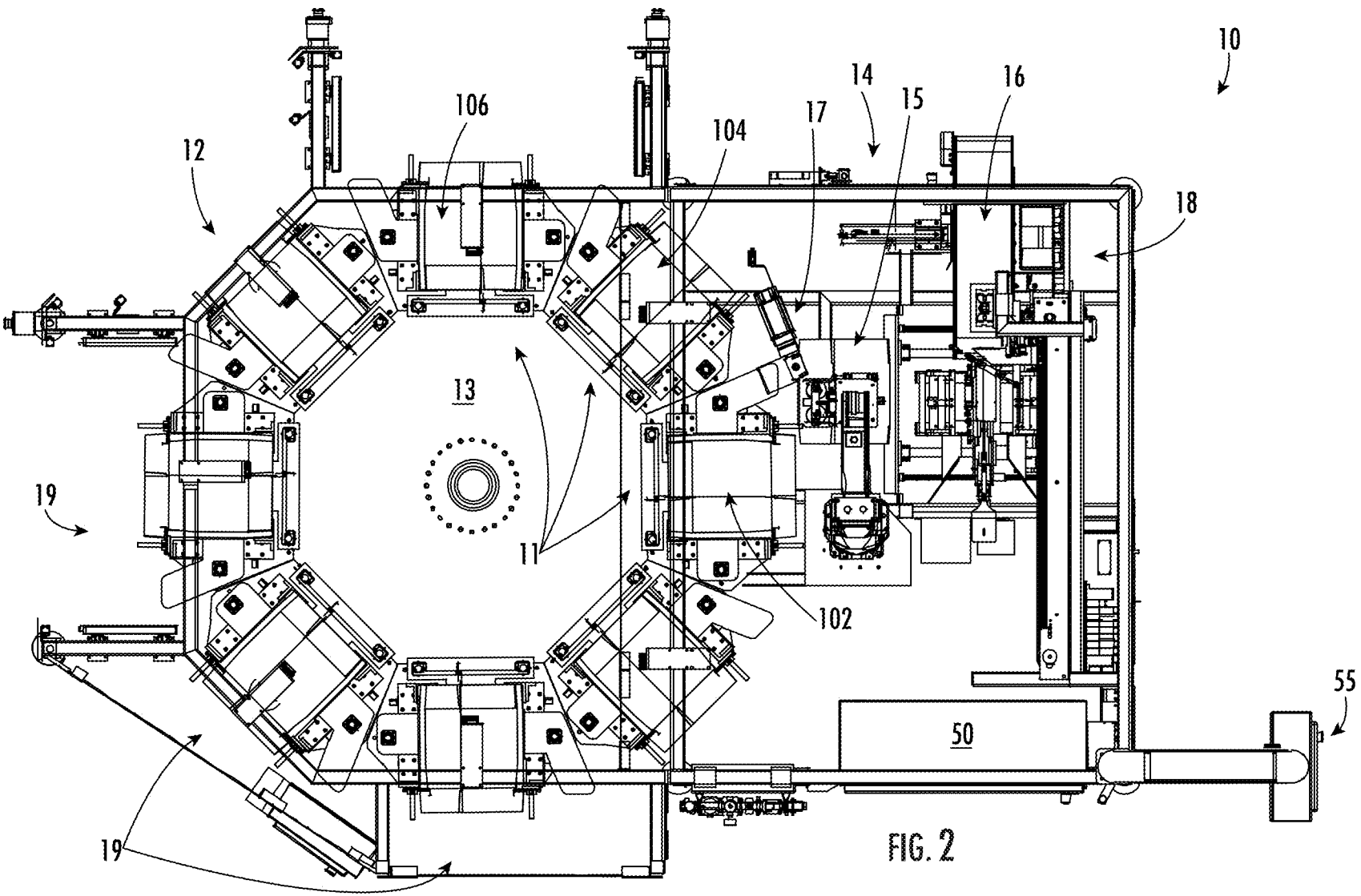
FIG. 2 is a top plan view of the cartoning machine of FIG. 1, in accordance with embodiments of the present disclosure.

An exemplary cartoning machine 10 (otherwise described herein as a cartoning apparatus 10) in accordance with the present disclosure is shown in FIGS. 1 and 2. The cartoning machine 10 includes a carton supply station 12 (e.g., a rotary carton supply station, a linear carton supply station, a non-linear carton supply station, or the like) and a handling station 14 operatively coupled to the carton supply station 12. The carton supply station 12 provides, on a selective basis, cartons, in some applications, carton blanks 102, 104, 106, pre-formed cartons, or the like. In the case of carton blanks 102, 104, 106, the carton blanks may be opened within the handling station 14. It should be understood that a "carton blank" is a term of art for when the carton is in a flat or blank state prior to being erected into a configuration that can hold or retain contents. In some embodiments, the carton blank may be required to be folded into a shape for packaging, or in other embodiments the carton blank may be flexible such that it be opened by simply expanding an opening of the carton (e.g., expandable paper, plastic, or the like). In some embodiments, the cartoning machine 10 may be utilized with pre-formed cartons (e.g., stacked plastic, cardboard, paper, or other like cartons).

The opened cartons (e.g., erected carton blanks, opened pre-formed cartons, or the like) may pass through a filling and/or closing station 16 for filling, closing, and/or further processing in the cartoning machine 10 or by another machine. The erected, opened, filled, and/or closed cartons may pass through an exit 18 of the cartoning machine 10 to supply the cartons to operators and/or other machines for other processing and/or use. In other embodiments, the cartoning machine 10 may pick, open, and/or erect the carton and the opened carton may be supplied to other machines for filling and closing.

The operation of the cartoning machine 10, including the carton supply station 12, the handling station 14 with a robot 15 (discussed in further detail below), and/or the closing station 16, as well as the communication between different systems may be controlled by a programmable controller 50, as will be described in further detail herein. A graphical user interface (GUI) 55 may be operatively coupled with the controller 50, and the controller 50 and GUI 55 may be used to permit an operator to set operating parameters, operate, monitor, adjust and/or the like the cartoning machine 10 and/or the cartons of the cartoning machine 10, as will be discussed in further detail herein.

The carton supply station 12 includes a plurality of magazines 11 (e.g., two or more magazines) that are allowed to move with respect to the robot 15 of the handling station 14. In some embodiments the robot 15 has at least one portion that is mounted in fixed location (e.g., a distal end of the robot is fixed to a support member, such as a base 13 while a proximal end is moveable to allow the robot 15 to pick the cartons). However, it should be understood that in some embodiments the location of the robot 15 and the magazines 11 may both be moveable with respect to each other to allow for more flexibility of the cartoning machine 10. In a particular embodiment, the robot 15 is mounted on a support (e.g., a moveable base, such as a rotatable base or turntable 13, or the like), which allows for positioning of the magazines 11 relative to the handling station 14 and/or one or more loading stations 19. For example, a motor (not shown) is operably coupled to the base 13 to move the base during operation of the cartoning machine 10 (e.g., rotatable base 13 to angularly displace the base 13 during operation of the cartoning machine 10). Alternatively, the magazines 11 may be moved along a conveyer, by independent machines (e.g., drivable wheel(s) on each magazine, or the like), through the use of a track, or the like in other embodiments of the invention.

As shown in the Figures, the carton supply station 12 may include eight (8) magazines 11 arranged along a periphery of the rotatable base 13. However, it should be understood that any number of magazines 10 may be utilized (e.g., 2, 3, 4, 5, 6, 7, 8, 9, 10, 12, 14, 16, 18, 20, or more magazines, or any number of magazines that range between, overlap, or fall outside of these values). The magazines 11 may be arranged to receive two or more stacks of dissimilar cartons (e.g., dissimilar carton blanks, pre-formed cartons, or the like) for handling by the cartoning machine 10. For example, stacks of carton blanks 102, 104, 106, etc. can be installed in the magazines 11, wherein each stack can be of a similar or different configuration. For example, the carton blanks 102 in a first magazine 11 can be of the same configuration as the carton blanks 104, 106 in a second and a third magazine 11. In another example, the carton blanks 102 in the first magazine 11 can be of a different configuration than the carton blanks 104, 106 in the second and the third magazines 11 for increased variety and to allow short runs of several differently configured cartons to be erected in succession or intermittently through the cartoning machine 10. In this way, each magazine 11 may be removeable (e.g., removable from the base 13) or each magazine 11 may be adjustable in order to hold different sized cartons. In this manner, the machine 10 can efficiently handle and process a first set of cartons (e.g., carton blanks 102, pre-formed cartons, or the like), a second dissimilar set of cartons (e.g., carton blanks 104, pre-formed cartons, or the like), a third dissimilar set of cartons (e.g., carton blanks 106, pre-formed cartons, or the like), or $n^{th}$ dissimilar set of cartons, without needing an operator to manually change-out the cartons in a stationary magazine to be handled and processed by the cartoning machine 10 as different sized cartons are requested for different products or for different amounts of the same product. With respect to being dissimilar, the cartons (e.g., carton blanks 102, 104, 106, pre-formed cartons, or the like) can have different attributes, such as sizes, configurations (e.g., peripheries, fold locations, opening locations, or the like), color layouts, labeling, text, graphics, or the like, or a combination of these different attributes.

The handling station 14 includes a robot 15 and a carton feeding mechanism (e.g., an elevator mechanism 17 as shown in FIG. 2, or other like feeding mechanism). The carton supply 12 operates to position the magazines 11 (e.g., a single magazine at a time or multiple magazines at a time from the plurality of magazines) adjacent to the robot 15 for engaging, picking and opening the carton (e.g., carton blanks, pre-formed cartons, or the like) from the magazines (e.g., a single magazine or multiple magazines). As previously discussed herein, in some embodiments the robot 15 may also be able to move locations (e.g., the distal end may be able to be moved), or the robot 15 may be able to reach two or more magazines 11 from the plurality of magazines 11 located adjacent the robot 15 (e.g., in a magazine picking location). However, in particular embodiments, the robot 15 has a distal end that is fixed and stationary, and can only pick cartons from a single magazine at a time. In some examples, the magazine 11 containing the carton blanks 102 is moved by the base 13 to be adjacent to the robot 15 in a magazine picking location, as shown in FIG. 2.

When a magazine 11 is located in the picking location, the carton feeding mechanism may be utilized in order to position one or more of the cartons (e.g., a stack of carton blanks 102, 104, 106, a pre-formed carton, or the like) in a robot pick-up position in which the robot 15 can pick the carton. For example, the carton feeding mechanism may comprise an elevator mechanism 17 that engages with the magazine 11 to move the stack of cartons (e.g., carton blanks 102, 104, 106, pre-formed cartons, or the like) in the magazine 11 to a pre-determined pick-up position for access by the robot 15 as shown in FIGS. 5-7A. For example, the stack of carton blanks 102 may be elevated within the magazine 11 such that the top exposed carton blank 102 is moved to the pre-determined pick-up position such that the robot 15 repeatably picks the carton blank 102 from the same pre-determined pick-up position. In addition to picking the robot 15, the robot 15 may engage the carton and/or may open the carton. The robot 15 may open the carton before the carton is moved, as the carton is being move, and/or after the carton is moved to another station.

In the embodiments where a closing station 16 is used, the robot 15 or another component may move the carton to the closing station 16 as shown in FIGS. 8-11. The closing station 16 may at least partially erect the cartons to form an erect carton 108 from the carton blanks 102, fill the erect carton 108, and/or move the erected cartons 108 to the exit 18 for filling, closing, or the like as suggested in FIGS. 12-14. The closing station 16 may be used to fold, operatively couple, and secure flaps of the cartons in order to create the erected carton with an open and closed end.

Figure 3:
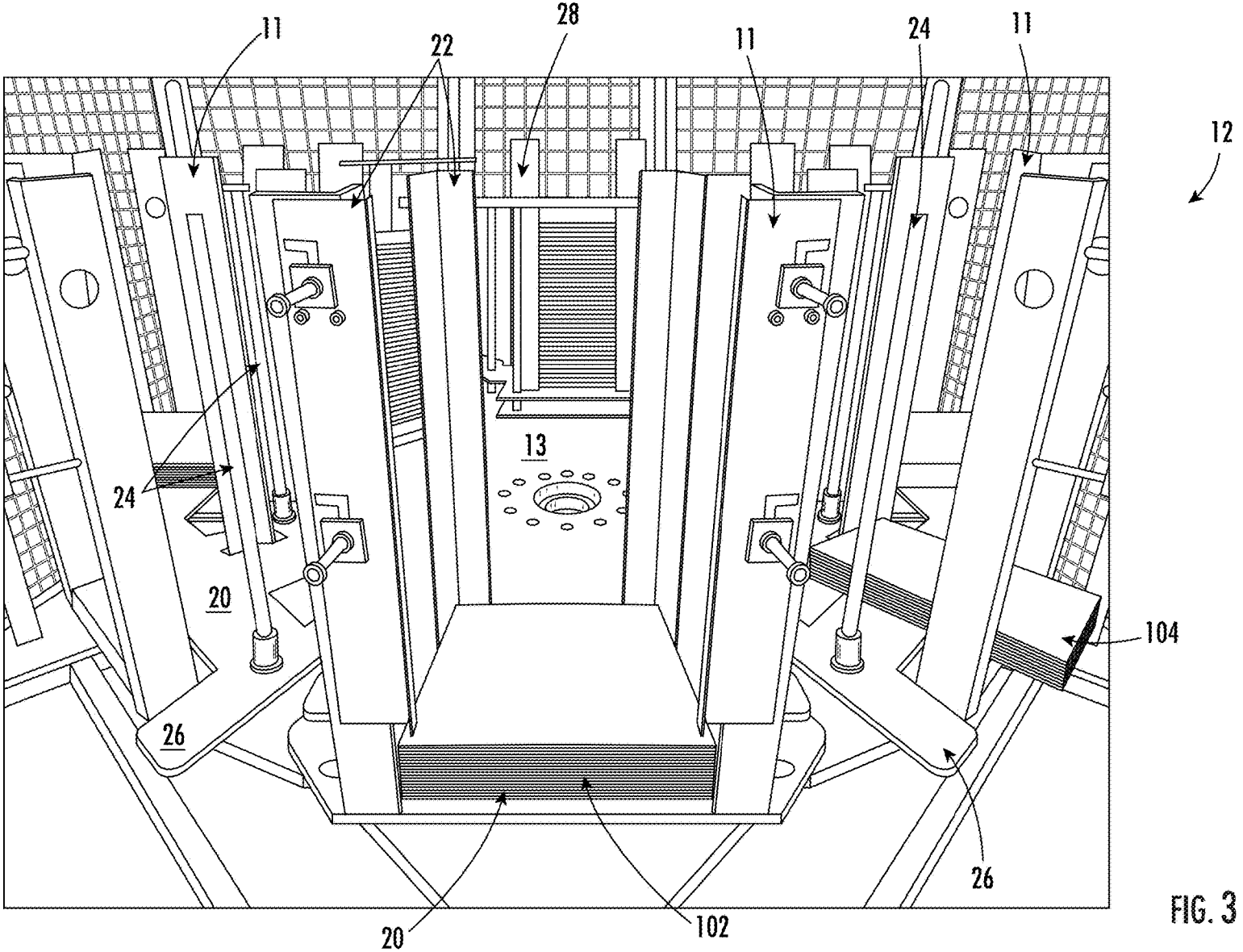
FIG. 3 is a perspective view of a rotary carton supply of the cartoning machine of FIG. 1 showing that the carton-blank supply includes a plurality of magazines mounted on a rotatable support to position the magazines relative to other portions of the cartoning machine, in accordance with embodiments of the present disclosure.
Figure 4:
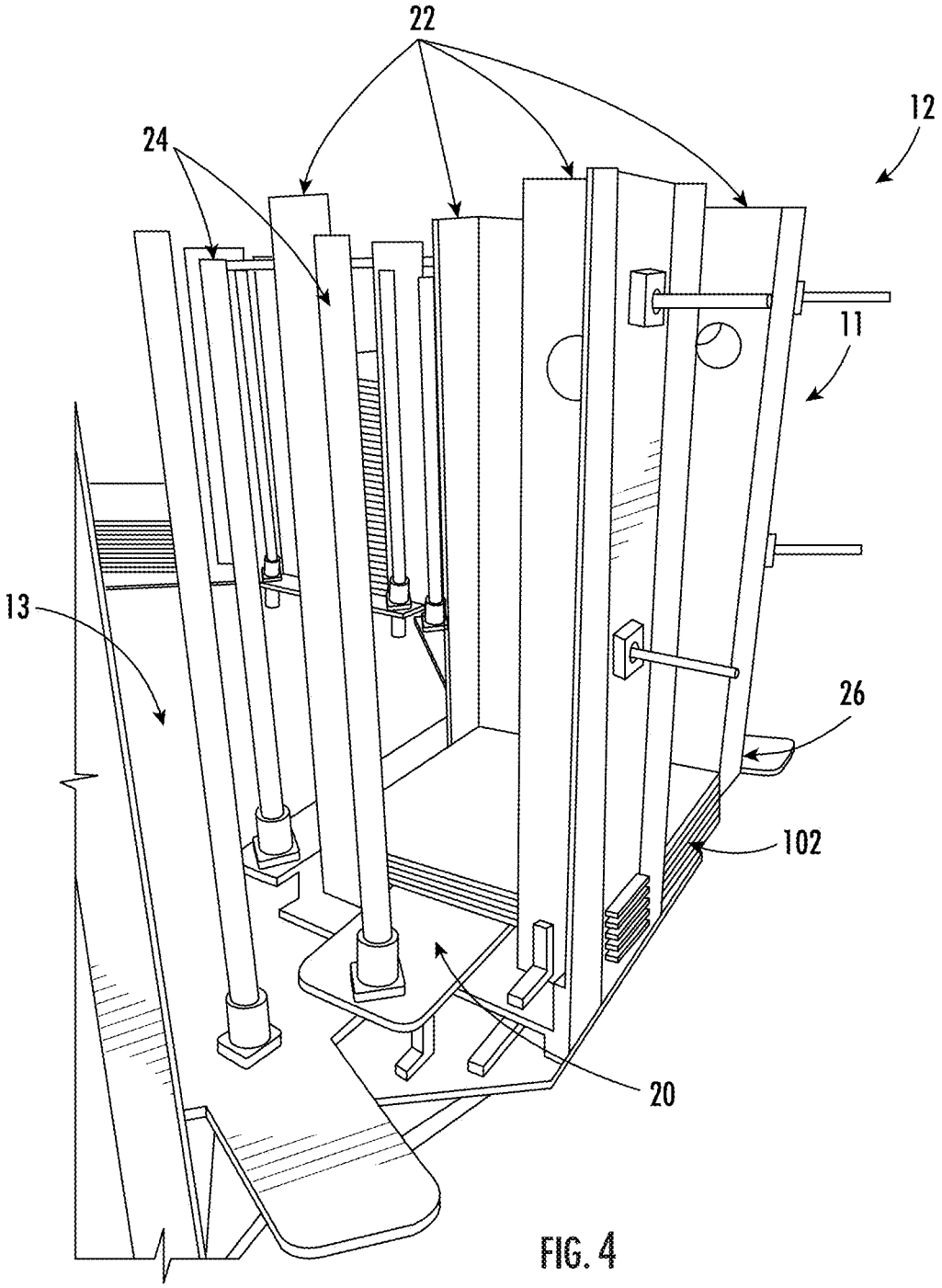
FIG. 4 is a perspective view of a magazine of the carton supply of FIG. 3, in accordance with embodiments of the present disclosure.

While the carton supply station 12, the handling station 14, and the closing station 16 have been described generally, the individual components of the foregoing may be described in further detail below. For example, as shown in FIGS. 3 and 4, each magazine 11 of the carton supply 12 may include a support member 20 (e.g., a support plate) and guide rails 22 extending from the support member 20. The cartons (e.g., carton blanks, pre-formed cartons, or the like) are stacked onto the support member 20, and the guide rails 22 maintain a relative orientation of the cartons (e.g., carton blanks, pre-formed cartons, or the like) within the magazine 11. In some embodiments, the guide rails 22 are adjustable to adapt for different sized and shaped cartons (e.g., carton blanks 102, or the like). For example, the guide rails 22 are positionable with respect to the support member 20 in different locations of the support member 20 (e.g., slidable, repositionable in different holes in the support member 20, or the like). In the illustrative embodiment, posts 24 maintain alignment of the support member 20 with the guide rails 22. A tab 26 may extend from the support members 20 for engagement by the carton feeder mechanism, such as the elevator mechanism 17 of the handling station 14 to raise and lower the support member 20. A projection component (e.g., a finger 28, or the like) may be operatively coupled to the magazine 11, such as on the guide rails 22, to engage with extent of the carton blanks 102 moved by the robot 15 to at least partially open or break (e.g., bend at one or more folds) the carton blank 102. The projection component 28 may be adjustable to adapt for different configurations of carton blanks 102, 104, 106 positioned within the magazine 11.

Figure 5:
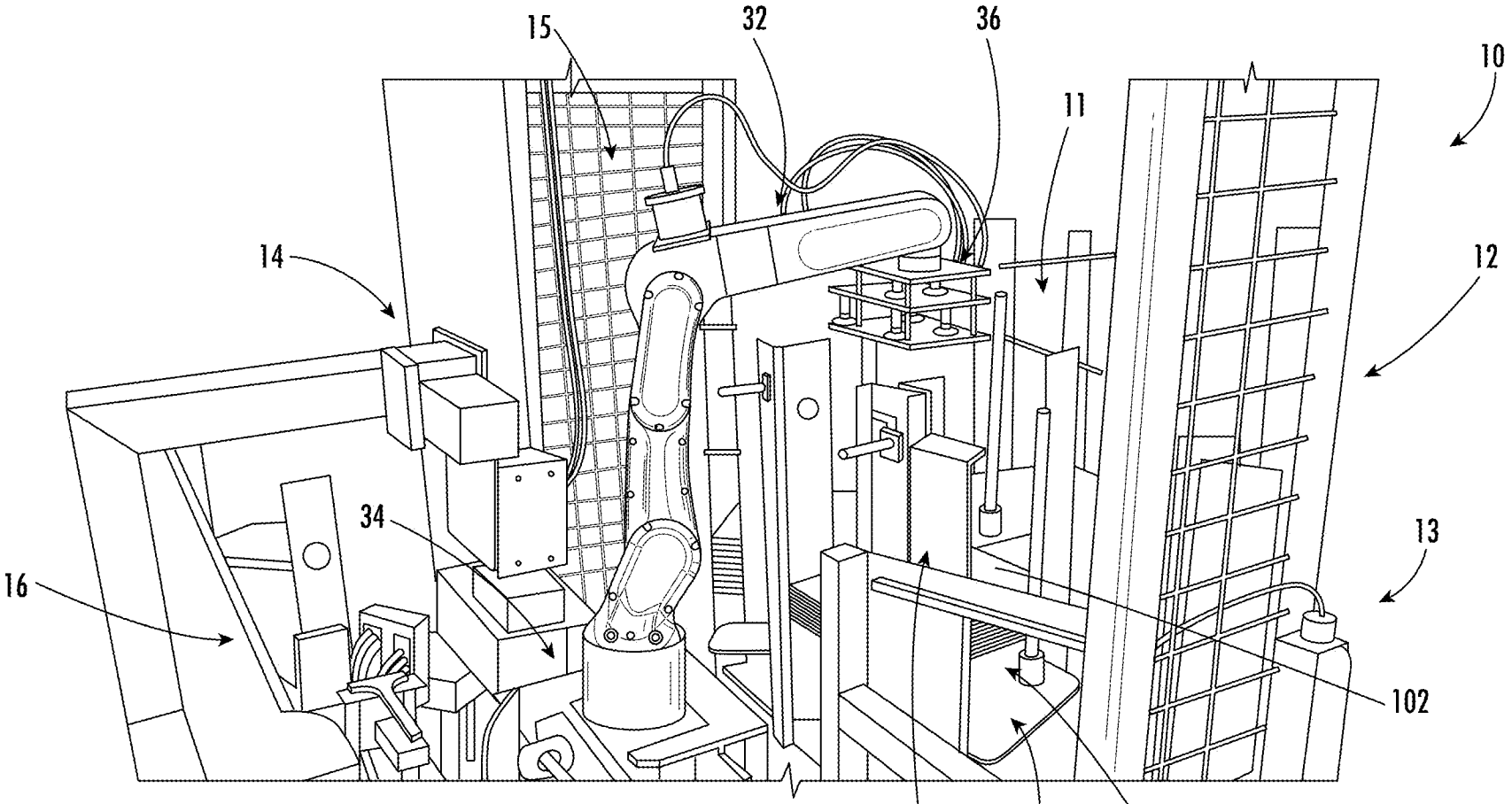
FIG. 5 is a perspective view of a handling station of the cartoning machine, showing a magazine of the carton supply arranged adjacent to a robot of the handling station to provide the robot with carton blanks for opening, in accordance with embodiments of the present disclosure.
Figure 7A:
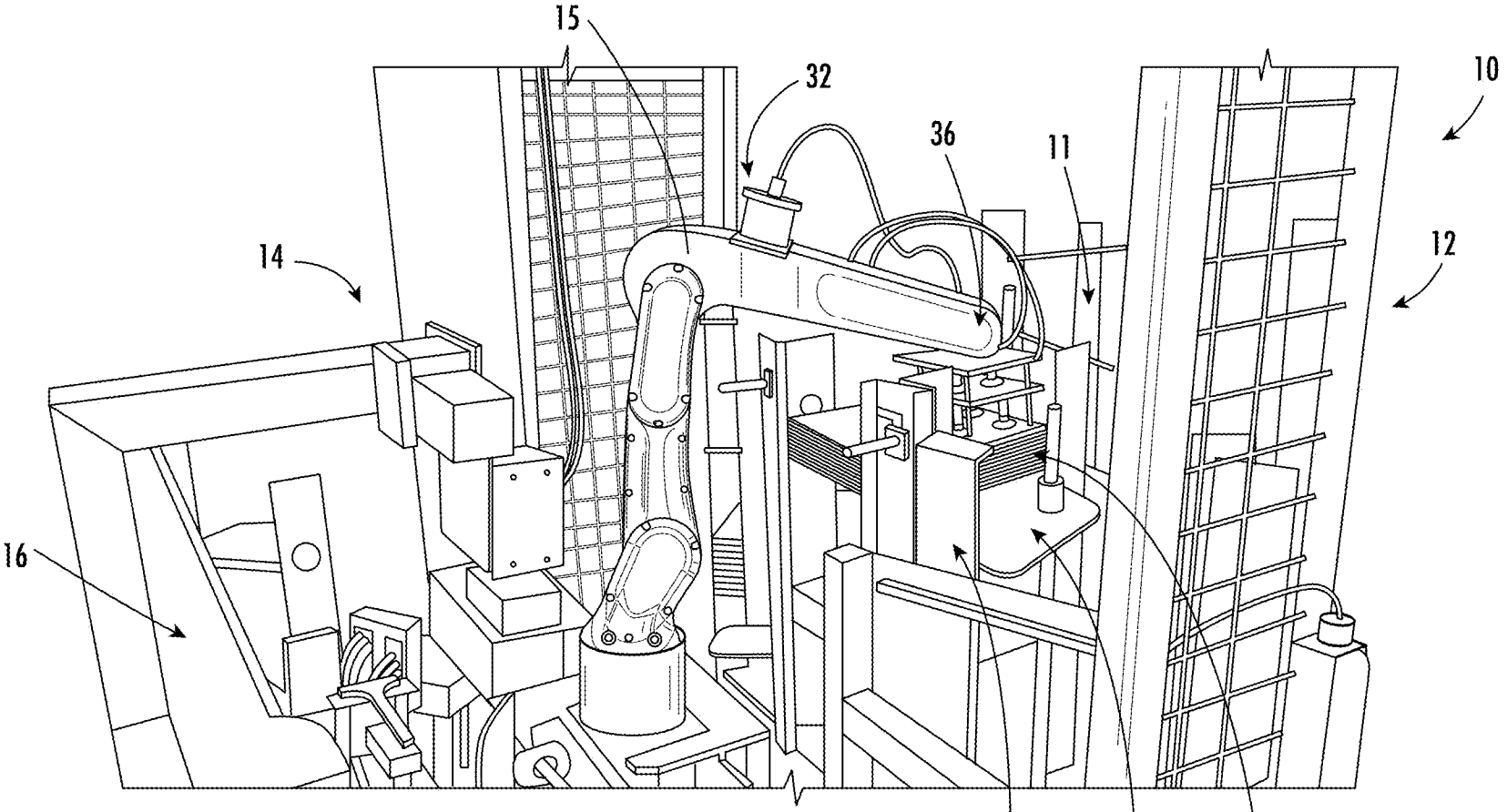
FIG. 7A is a perspective view similar to FIG. 5 showing the robot gripping an uppermost carton blank in a stack of carton blanks in the magazine, in accordance with embodiments of the present disclosure.
Figure 7B:
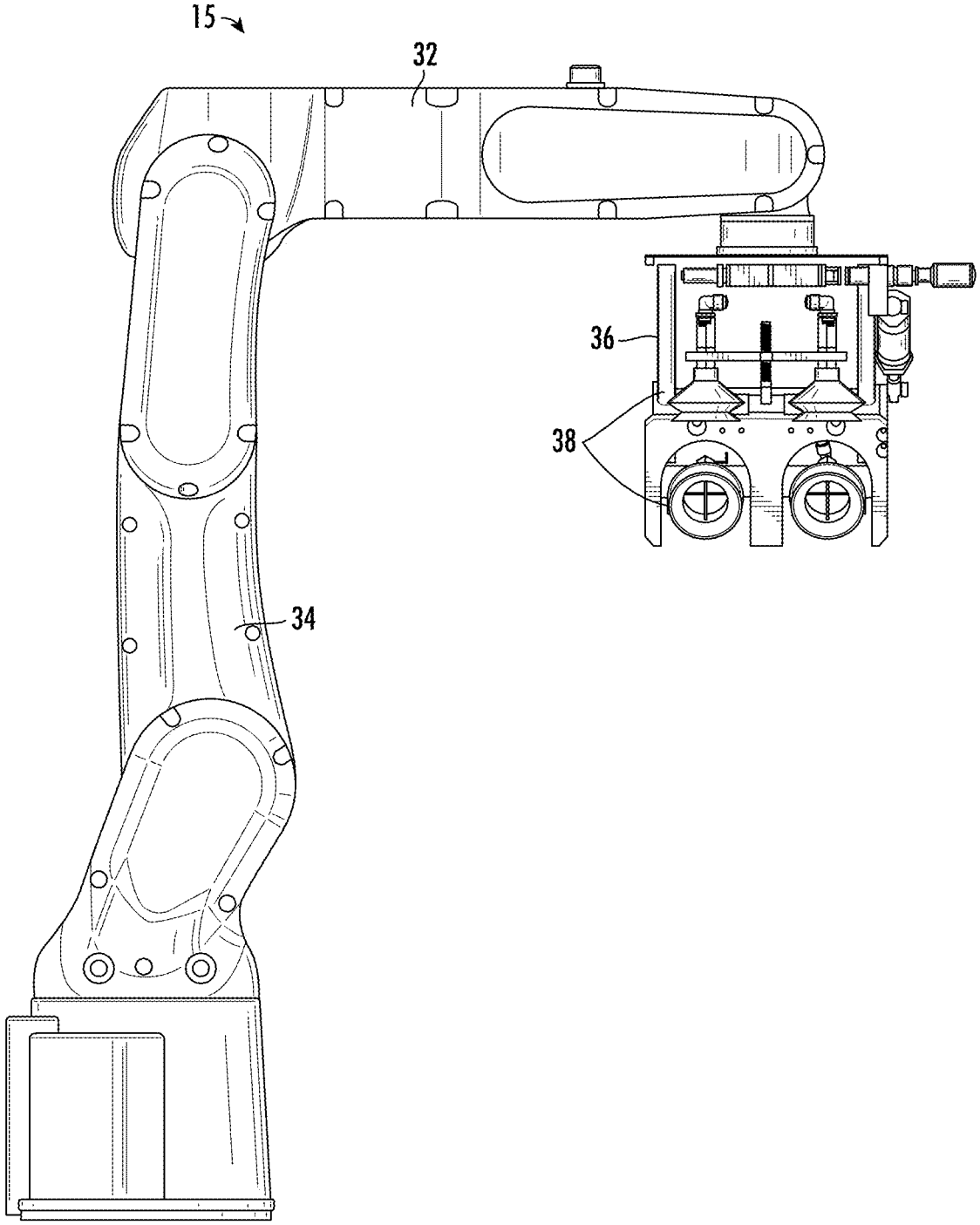
FIG. 7B is a side view of the robot illustrating the hand with the gripping components, in accordance with embodiments of the present disclosure.
Figure 7C:
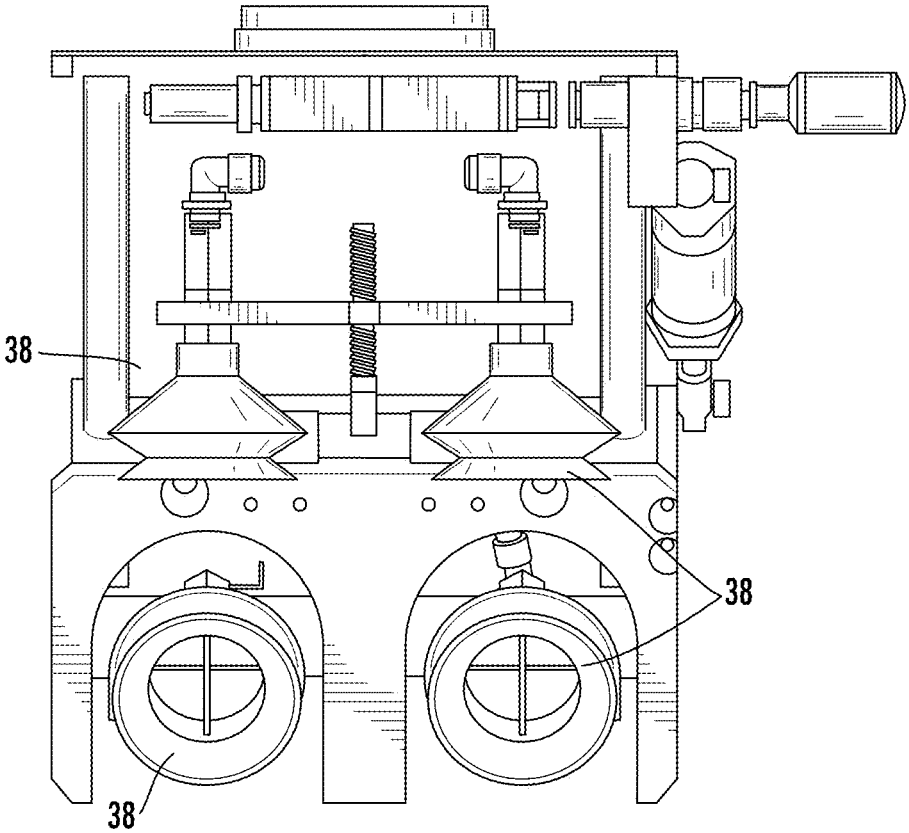
FIG. 7C is an enlarged side view of the robot of FIG. 7B illustrating the hand with the gripping components, in accordance with embodiments of the present disclosure.
Figure 7D:
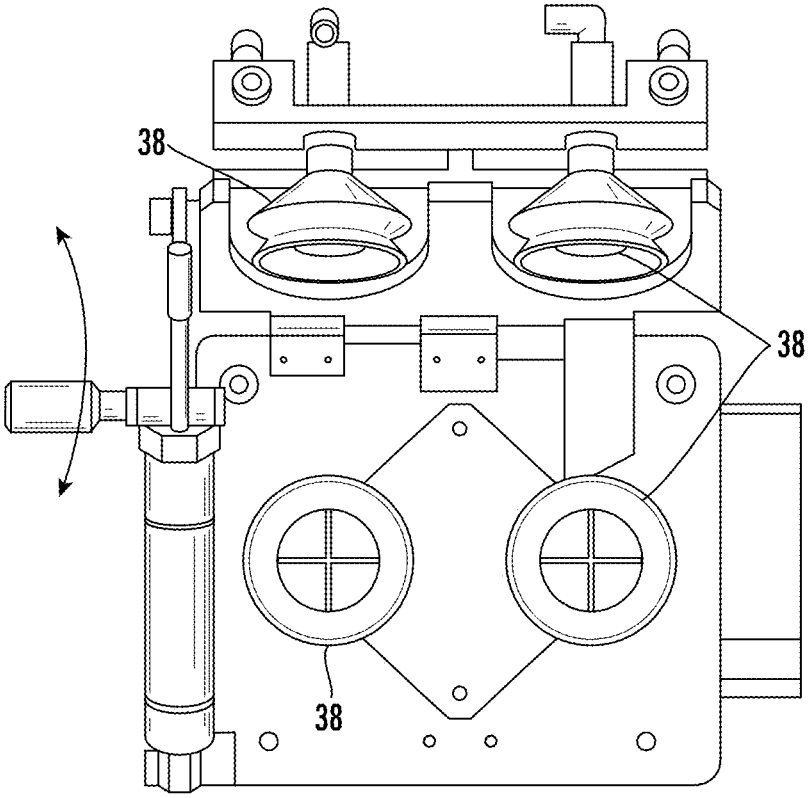
FIG. 7D is an enlarged bottom view of the robot of FIG. 7B illustrating the hand with the gripping components, in accordance with embodiments of the present disclosure.

As illustrated in FIGS. 7B-7D, the robot 15 of the handling station 14 may include one or more moveable arms. In some embodiments a first arm 32 is operatively coupled to a second arm 34 as shown in FIG. 5. In other embodiments, a robot having more arms may be utilized. A gripping hand 36 may be operatively coupled to the first arm 32 for movement with the first arm 32 relative to the second arm 34. In the illustrative embodiment, the gripping hand 36 includes two or more suction components 38 (e.g., a plurality of suction devices, or the like) for gripping the carton (e.g., carton blanks 102). For example, the two or more suction components 38 may utilize air suction to pick a carton from the magazine 10. As illustrated by FIGS. 7C and 7D, at least one first suction component 38 may be located on a first plane, and at least one second suction component 38 may be located on a second plane. The at least one first suction component 38 on the first plane (e.g., first suction mount) may move with respect to the at least one second suction component on the second plane (e.g., the second suction mount). For example, the suction components may be in the same plane (e.g., 180 degrees in line) or may rotate with respect to each other (e.g., 90 degrees with respect to each other as illustrated in FIGS. 7B-7D). In other embodiments, the gripping hand 36 may have fingers used to select a carton, a projection used to insert into a carton, or other component use to pick a carton from a magazine 11.

It should be understood that one or more sensors 315 may be utilized for various purposes, such as but not limited to security, safety, supply, identifying the location of components of the cartoning machine 10, positioning of a carton, or the like. The one or more sensors 315 may be any type of sensor, such as a light curtain, camera, radar, infrared, laser, accelerometer, force, radio frequency identification (RFID), pressure sensor, or the like. For example, the cartoning machine 10 may comprise one or more safety sensors that are configured to identify when an object (e.g., a user, equipment, or the like) enters a zone (e.g., a distance from, within, crossing a boundary of one of the stations, such as a carton supply station 12, the handling station 14, the closing station 16, or the like) that the object should not be in, such as when the cartoning machine is operating. In some embodiments, one or more magazine sensors may be utilized in order to determine the location of a magazine with respect to the magazine picking location and/or with respect to the location of the robot 15. In some embodiments a carton sensor may be utilized to identify the location of a carton (e.g., an upper most carton in a stack) in one or more of the magazines 10, such as when a carton is located at the pre-determined pick-up position. Additionally, one or more robot sensors may be utilized to determine the position of the robot 15 or a component thereof (e.g., the hand, a suction component, or the like), the force with which a robot may be contacting an object (e.g., a carton, or the like), or the like.

FIG. 15 provides a method of selecting, picking, opening, filling, and/or closing a carton 200. As illustrated by block 202 of FIG. 15, the plurality of magazines 11 are supplied with two or more types of cartons (e.g., carton blanks 102, 104, 106, etc., pre-formed cartons, or the like), such as two or more cartons having different attributes, such as cartons of different sizes, types, graphics, openings and/or closings locations, or the like. The magazines 11 may be manually and/or automatically adjusted for different sizes, and/or manually and/or automatically supplied with the two or more cartons. Moreover, in some embodiments entire magazines may be pre-loaded and swapped out as requested. In some embodiments, the magazines 11 may be loaded with the cartons when the magazines 11 are located in one or more loading stations 19. As illustrated in the figures, one or more magazines 11 may be loaded from loading stations 19 located on the outside of the carton supply station 12, such as outside of the annular base 13 of the carton supply station 12.

Block 204 of FIG. 15 further illustrates that the controller 50 and/or the graphical user interface 55 may be used to automatically and/or manually make selections of one or more operating parameters of the cartoning machine 10, such as the carton attributes, types of cartons, sequence of carton use, number of cartons, product for filing the cartons, amount of product to fill the carton, operating speed, operating duration, or the like. The controller 50 and/or user interfaces 55 will be described in further detail below; however, it should be understood that the controller 50 may be part of one or more carton systems 310, and may communicate with other systems within (e.g., multiple product system supplying different products) or outside of the facility (e.g., for remote monitoring, operation, or the like).

A illustrated by block 206 of FIG. 15 the carton supply 12 moves a magazine 11 from the two or more magazines 11 into position adjacent to the robot 15 in a magazine picking location (e.g., adjacent a second arm 34 of the robot 15) for allowing access to the cartons (e.g., the carton blanks 102, 104, 106, pre-formed cartons, or the) by the hand 36 of the robot 15. In some embodiments, a magazine location sensor, as previously described herein, may be utilized to determine when the magazine 11 with the requested carton is located in the magazine picking location.

Figure 6:
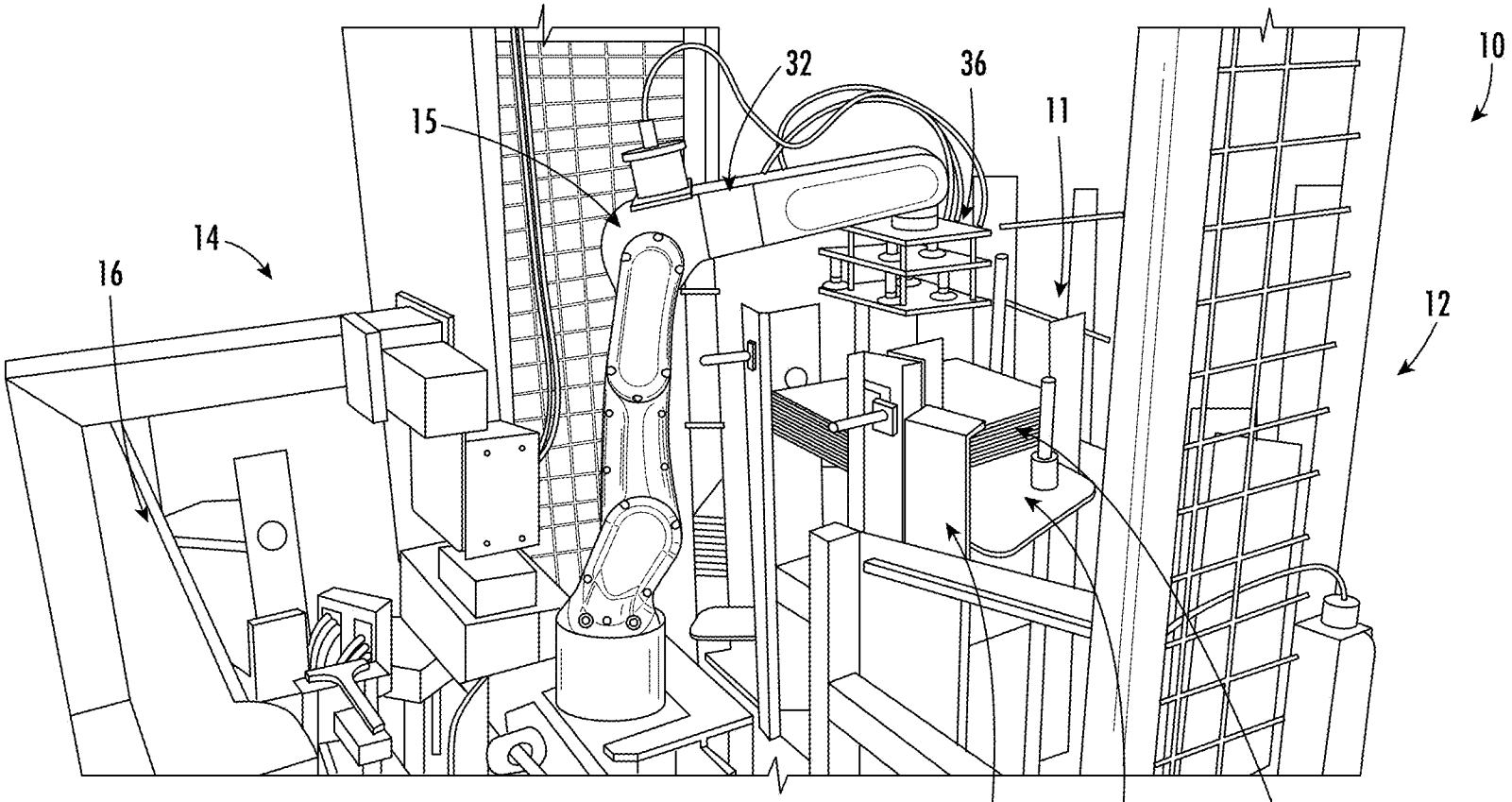
FIG. 6 is a perspective view similar to FIG. 5 showing a support plate of the magazine raised to arrange the carton blanks in a pick-up position for access by the robot of the handling station, in accordance with embodiments of the present disclosure.

Block 208 further illustrates that the carton feed mechanism is used to move the carton to a pick-up position (e.g., a pre-determined pick-up position). For example, the elevator mechanism 17 engages with the support member 20 (e.g., support plate), such as the tab 26, to move the cartons (e.g., carton blanks 102, 104, 106, pre-formed cartons, or the like) to the pre-determined pick-up position, as illustrated in FIG. 6. The pre-determined pick-up position may be the same location each time the robot 15 picks a carton from any of the magazines 11 in order to allow for repeatability and improved accuracy for the robot 15 picking cartons. In the illustrative embodiment, a single elevator mechanism 17 is used to engage with the magazine 11 positioned adjacent to the robot 15 and move the carton blanks 102, 104, 106 to the pick-up position. In some embodiments, each magazine 11 is provided with its own carton feeder mechanism (e.g., dedicated elevator mechanism 17).

Block 210 illustrates that the hand 36 of the robot 15 is moved to the predetermined pick-up position to engage with the carton (e.g., with the carton blanks 102 as shown in FIG. 7). As previously discussed herein, the hand 36 of the robot 15 may pick the carton through the use of one or more suction components 38 previously discussed herein; however, other types of grippers may be used to pick the carton.

Figure 8:
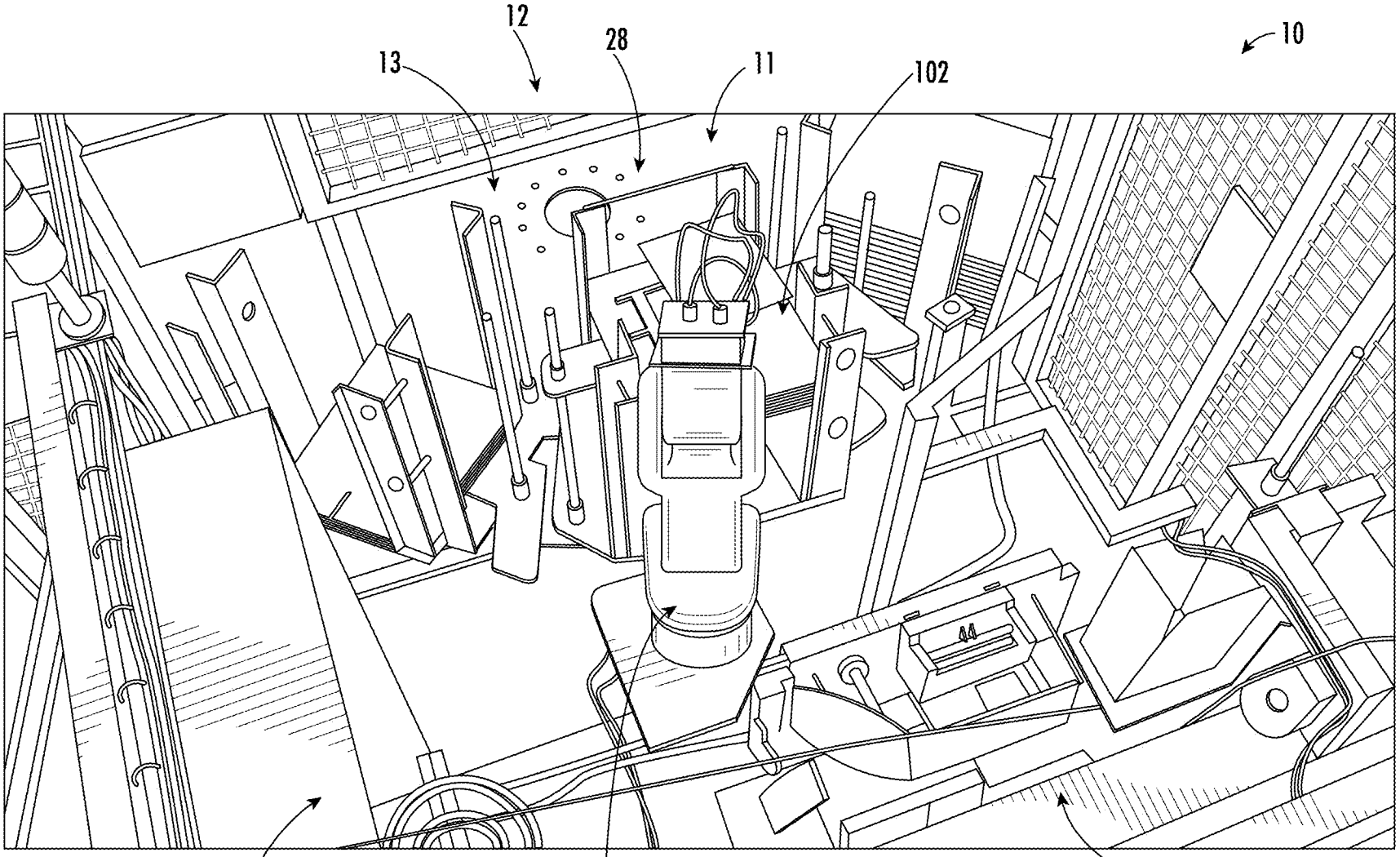
FIG. 8 is an upper perspective view of the handling station of FIG. 7A, in accordance with embodiments of the present disclosure.
Figure 9:
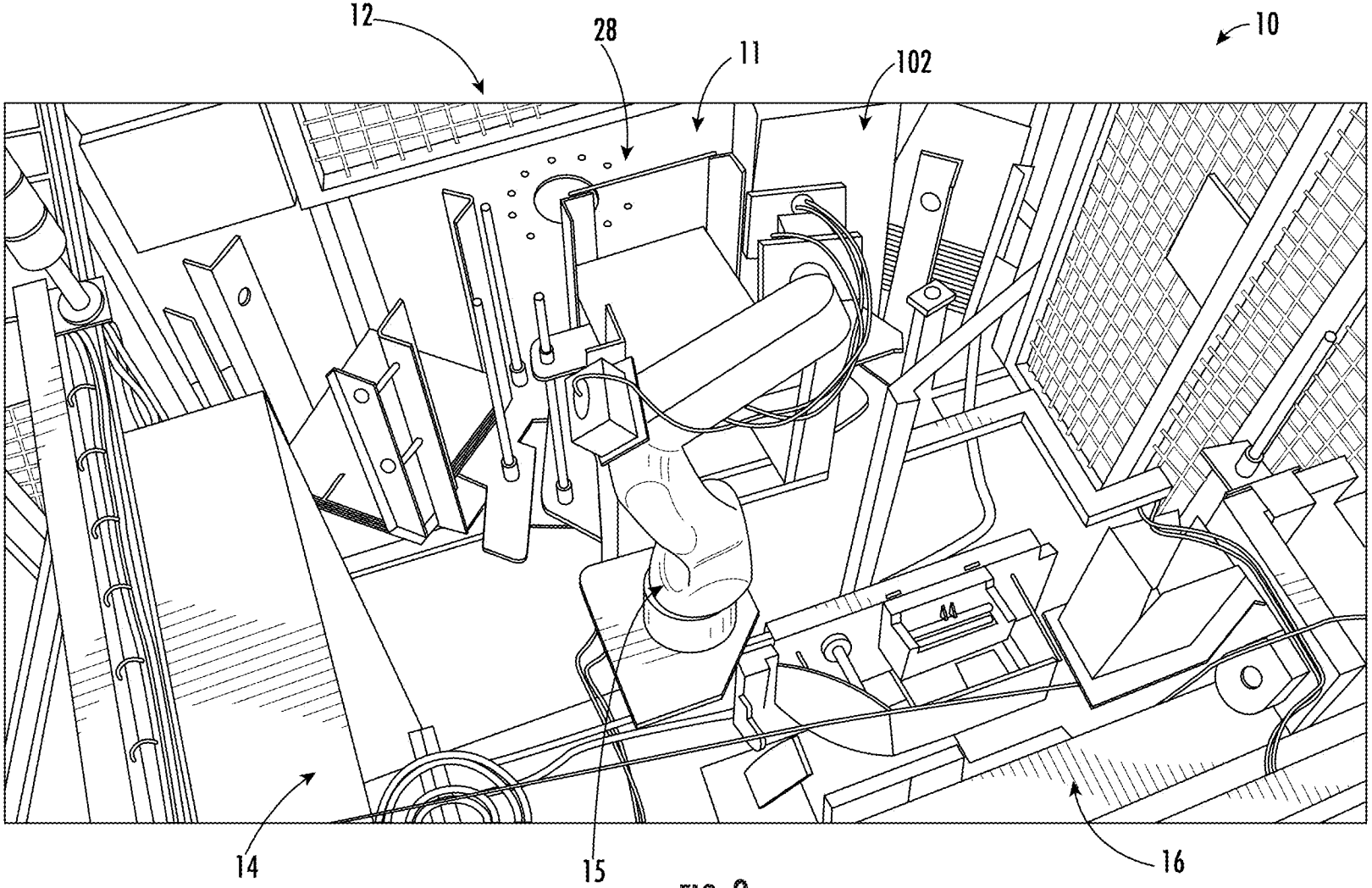
FIG. 9 is an upper perspective view similar to FIG. 8 showing the robot lifting a carton blank from the magazine and suggesting that a projection of the magazine is engaged with the carton blank during removal from the magazine by the robot to at least partially open the carton blank, in accordance with embodiments of the present disclosure.

FIG. 15 further illustrates in block 212 that in order to open a carton, such as for example, a carton blank 102, the robot 15 grips the carton blank 102 located in the pick-up position (e.g., the top carton blank 102 in the stack), and lifts the carton blank 102 away from the magazine 11 (e.g., out of, or the like), as shown in FIGS. 8 and 9. In some embodiments, the projection 28 of the magazine 11 engages with an extent of the carton blank 102, such as an upper or lower flap of the blank 102 to at least partially open the blank 102. The projection 28 may engage the extent of the carton during movement by the robot 15 away from the magazine 11. However, it should be understood that the carton may be partially opened and/or opened in a number of ways depending on the type of carton. For example, the hand of the robot 15, an opening station, a projection located outside of the magazine 11, or the like.

Figure 10:
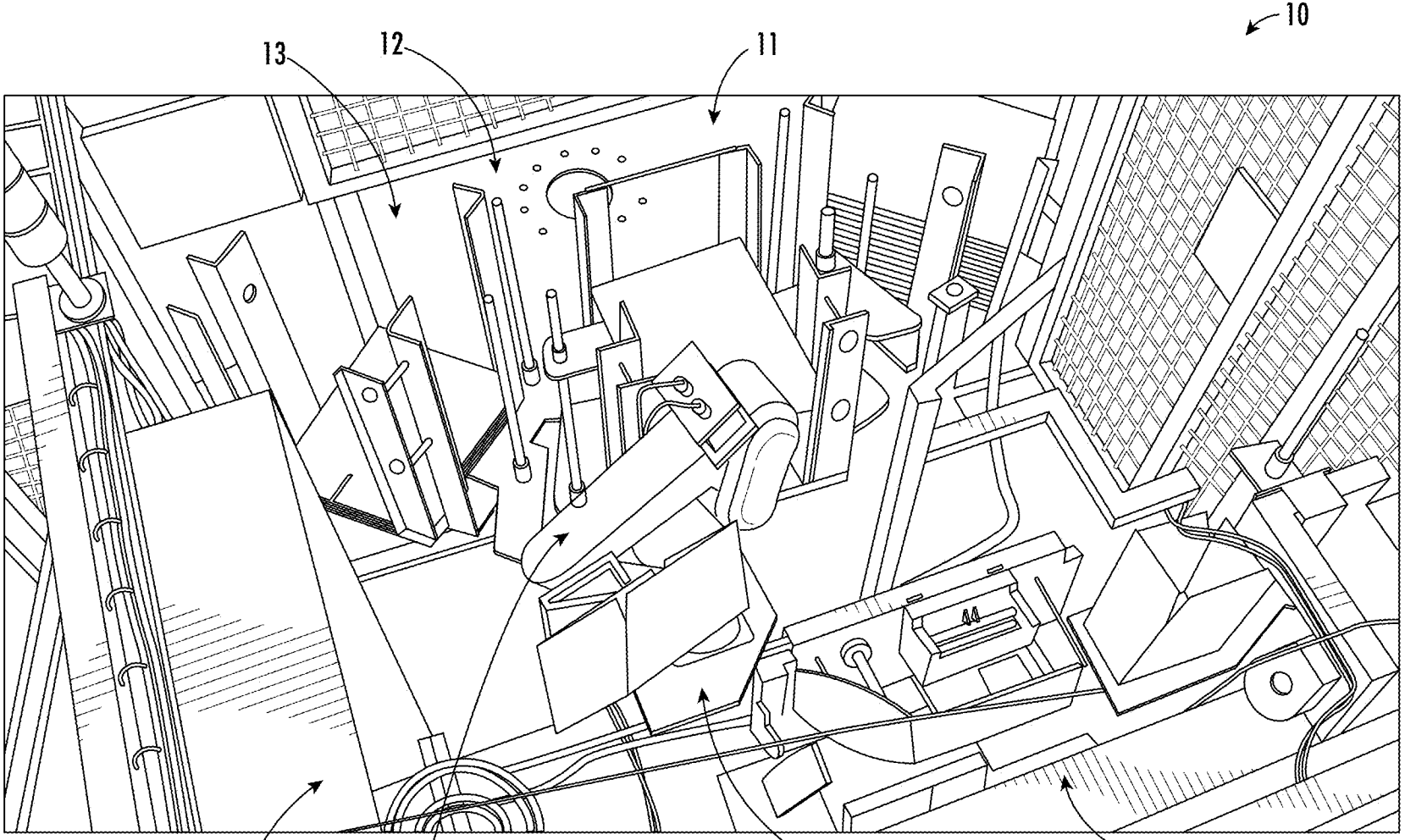
FIG. 10 is an upper perspective view similar to FIG. 9 showing the robot positioning the carton blank over a closing station of the cartoning machine, in accordance with embodiments of the present disclosure.
Figure 11:
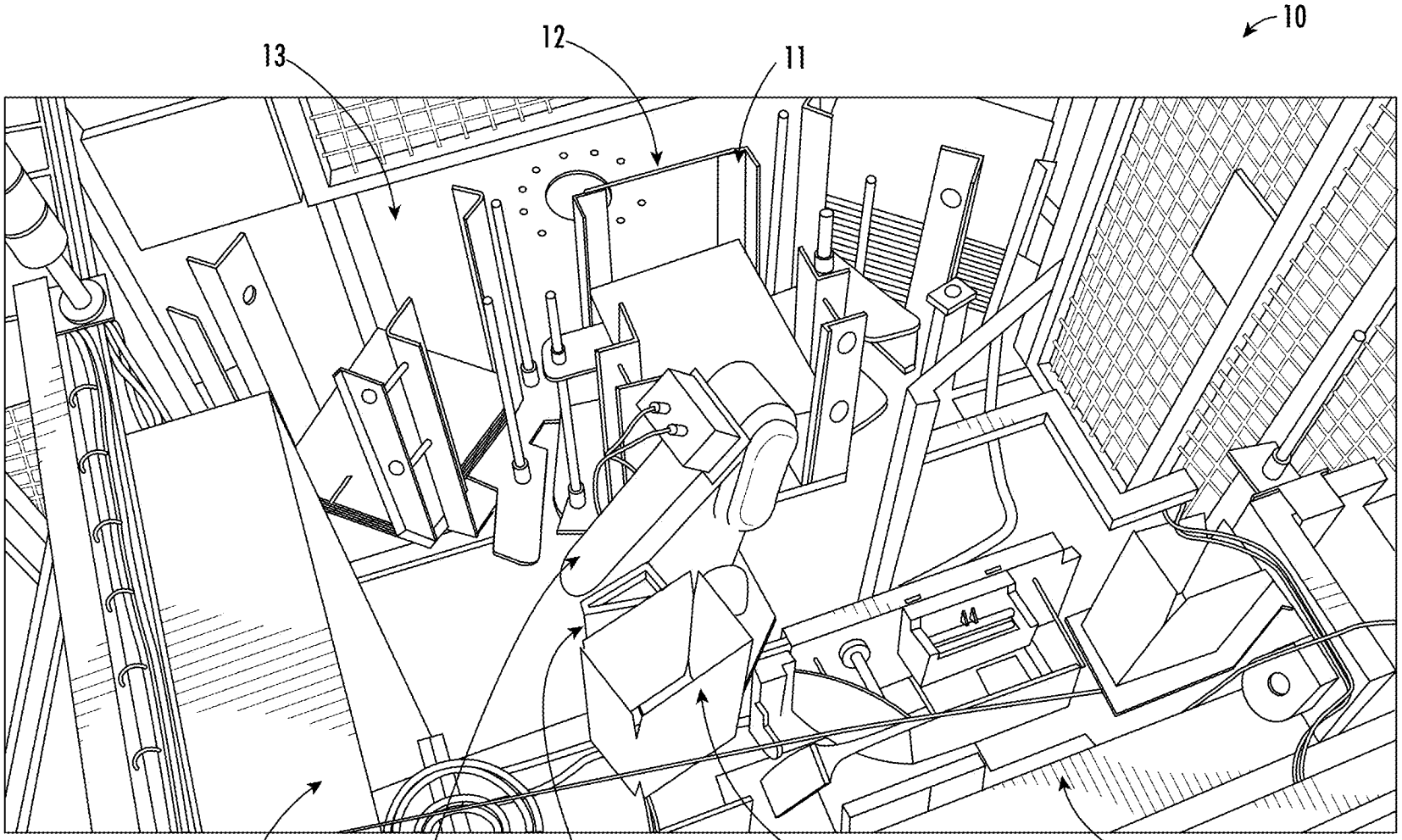
FIG. 11 is an upper perspective view similar to FIG. 10 showing the carton blank opened by the robot, in accordance with embodiments of the present disclosure.

Block 214 of FIG. 15 further illustrates that the robot 15 moves the carton (e.g., the carton blank 102) toward the closing station 16 as shown in FIG. 10. Before, during, or after the robot 15 moves the carton toward the closing station 16, the hand 36 of the robot 15 can further articulate to open the carton (e.g., the carton blank 102). The articulation may include two suction components articulating from a first orientation (e.g., 180 degrees with respect to each other, or the like) to a second orientation (e.g., 90 degrees with respect to each other, or the like). In some embodiments, the articulation of the hand may occur as the robot 15 is moving towards the closing station 16, which can minimize complexity in programming operation of the robot 15. In some embodiments, the robot 15 coordinates with the closing station 16 in opening the carton (e.g., the carton blanks 102). For example, the robot 15 can move the carton (e.g., the carton blank 102) to the closing station 16, and the closing station 16 grips the carton blank 102 as the robot 15 moves to open the carton blank 102. Again, it should be understood that the carton may be partially opened and/or opened in a number of ways depending on the type of carton.

Figure 12:
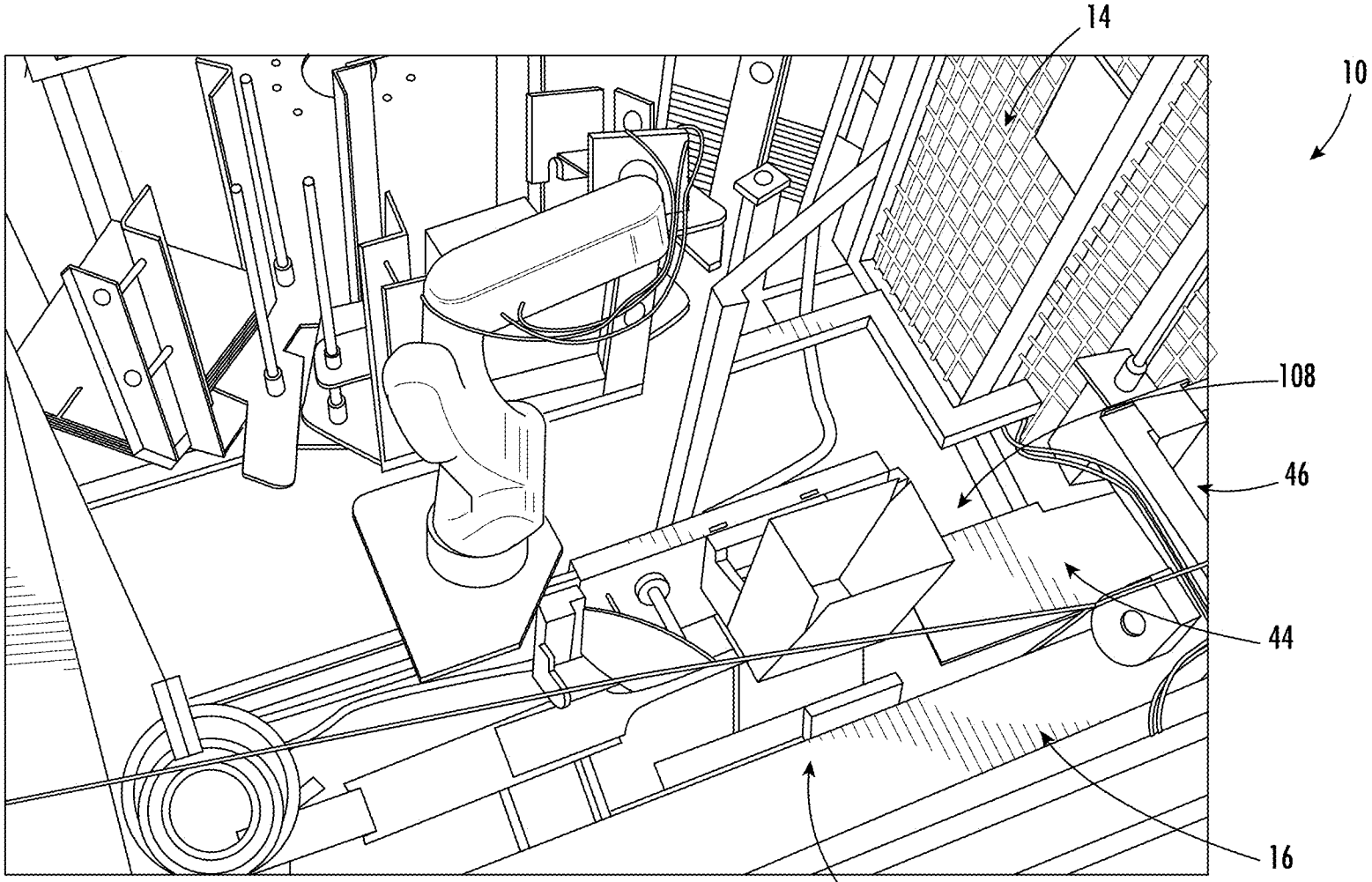
FIG. 12 is an upper perspective view similar to FIG. 11 showing the carton blank arranged at a flap-folding section of the closing station and suggesting that the closing station folds bottom flaps of the carton blank for closing a bottom of the carton blank to erect a carton, in accordance with embodiments of the present disclosure.
Figure 13:
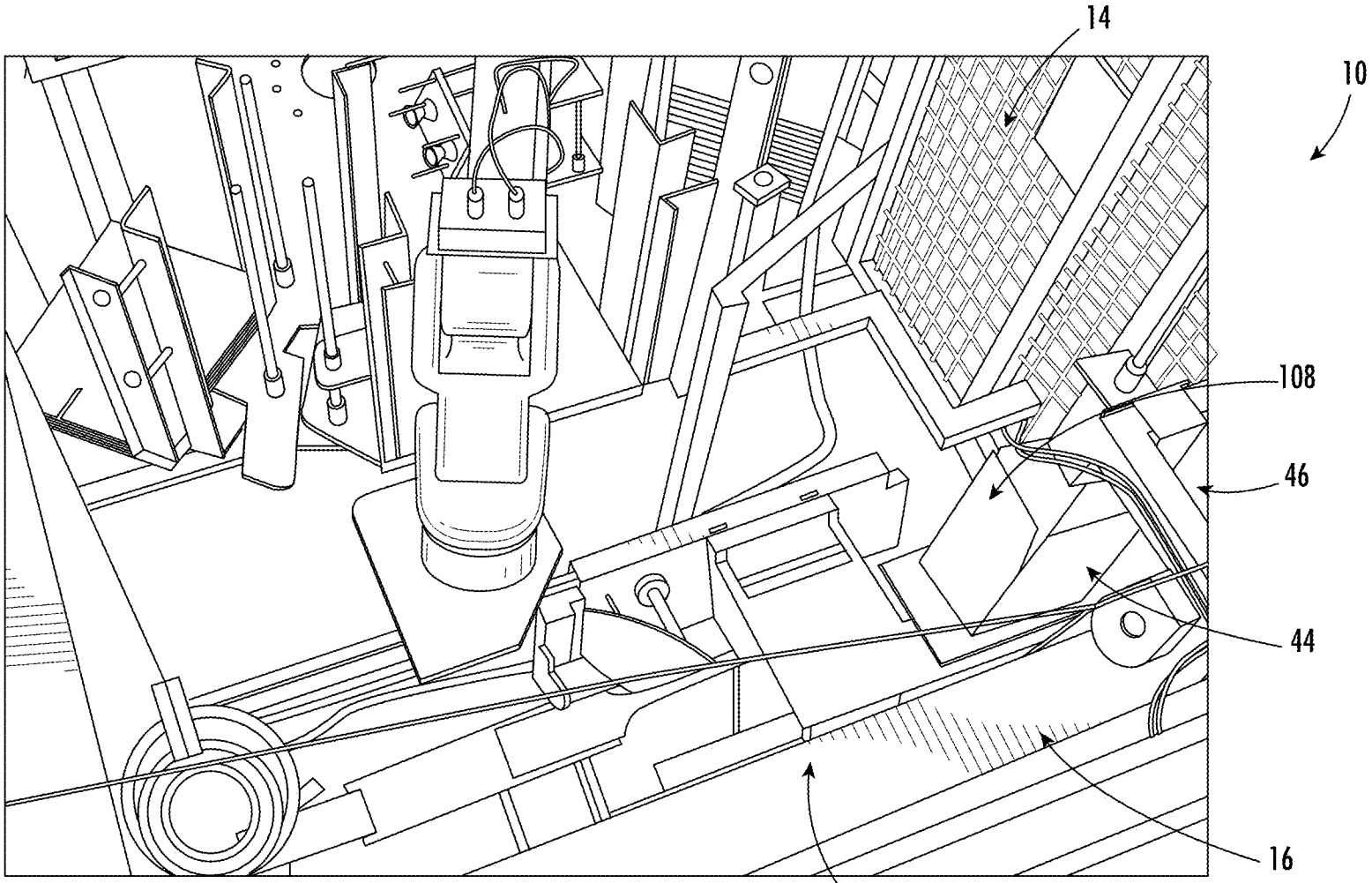
FIG. 13 is an upper perspective view similar to FIG. 12 showing the carton blank arranged at a pressing station of the closing station and suggesting that a ram engages with the bottom flaps to press the flaps together against an adhesive applied to the flaps, in accordance with embodiments of the present disclosure.
Figure 14:
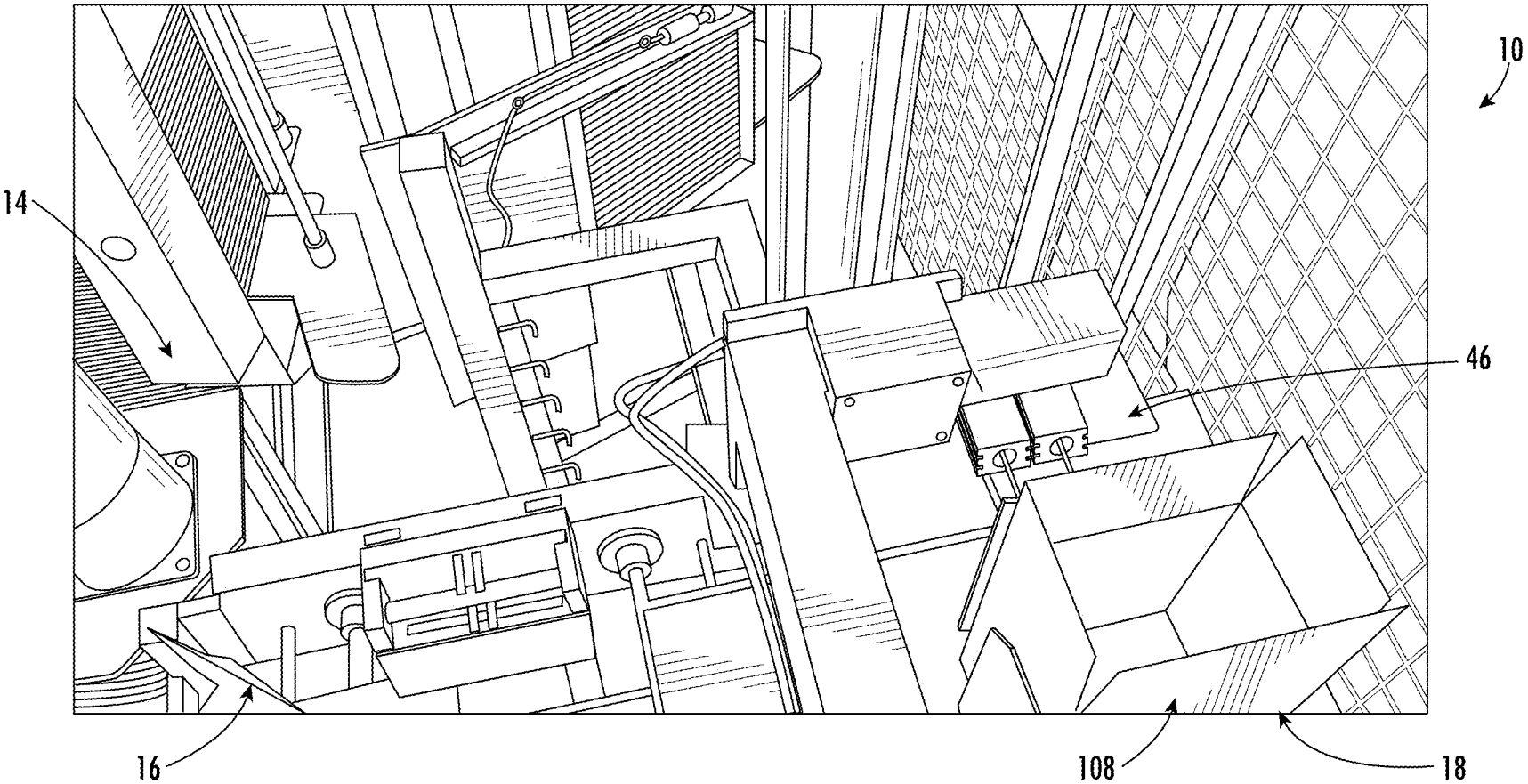
FIG. 14 is a perspective view of a delivery station of the closing station showing the erected carton being moved out of the cartoning machine for filling or further processing, in accordance with embodiments of the present disclosure.

FIG. 15 further illustrates in block 216 that the opened carton (e.g., the opened carton blank 102) moves through the closing station 16 to form an erected carton 108 as shown in FIGS. 12-14. In the illustrative embodiment, the closing station 16 includes a flap-folding station 42, a pressing station 44, and a delivery station 46 in order to close one end of the erected open carton 108. The flap-folding station 42 engages with bottom or top flaps of the opened carton blank 102 to fold the flaps and form a closed top or bottom of an erected carton 108. An adhesive, such as tape or glue for example, can be applied to the flaps for holding the flaps closed. The pressing station 44 engages with the folded flaps to press the flaps against the adhesive for securing the flaps closed. The erected carton 108 moves to the delivery station 46 and is pushed out through the exit 18 of the cartoning machine 10 for access by an operator or other machine for filling or further processing of the erected carton.

In some embodiments of the invention the closing station 16 may not be required to close an open end, as the carton may only have one opening. In some embodiments, the cartoning machine 10 includes additional stations for filling of the carton with products (e.g., product, such as a powder, liquid, gel), and then closing of the cartons. In some embodiments instead of using an adhesive, other couplings, such as fasteners (staples, or the like), zip closure, tags, clips, or the like may be used, formed, or engaged in order to close the carton 108.

The present invention disclosed herein has improvements over conventional cartoning systems. For example, by moving the magazines, in particular the rotational movement, with respect to the robot 15 (e.g., robot fixed end does not move), and having the single known pick-up position for the robot 15 reduces complexity, improves efficiency of the pick-up process including the programmed operation of the robot 15, and minimizes the size of the carton supply station 12, the handling station 14, and the robot 15 for forming cartons from the blanks 102, 104, 106. Conventional cartoning machines may include multiple magazines of carton blanks having the same or different sizes and/or configurations, however, the magazines are arranged across a large staging area or holding area. For example, two or more magazines are arranged in racks in a staging area surrounding the cartoning machine, whereby the machine's robot must traverse a considerable distance to move across the staging area to access the magazines containing different carton blanks. This traversal process takes the robot considerable time and requires a large footprint that consumes valuable workspace by the robot and the cartoning machine. Also, when a magazine is emptied of a particular carton size or type, the re-loading process by a human operator takes a considerable amount of time and effort. These limitations reduce the desirability and efficiency of conventional cartoning machines 10.

Figure 16:
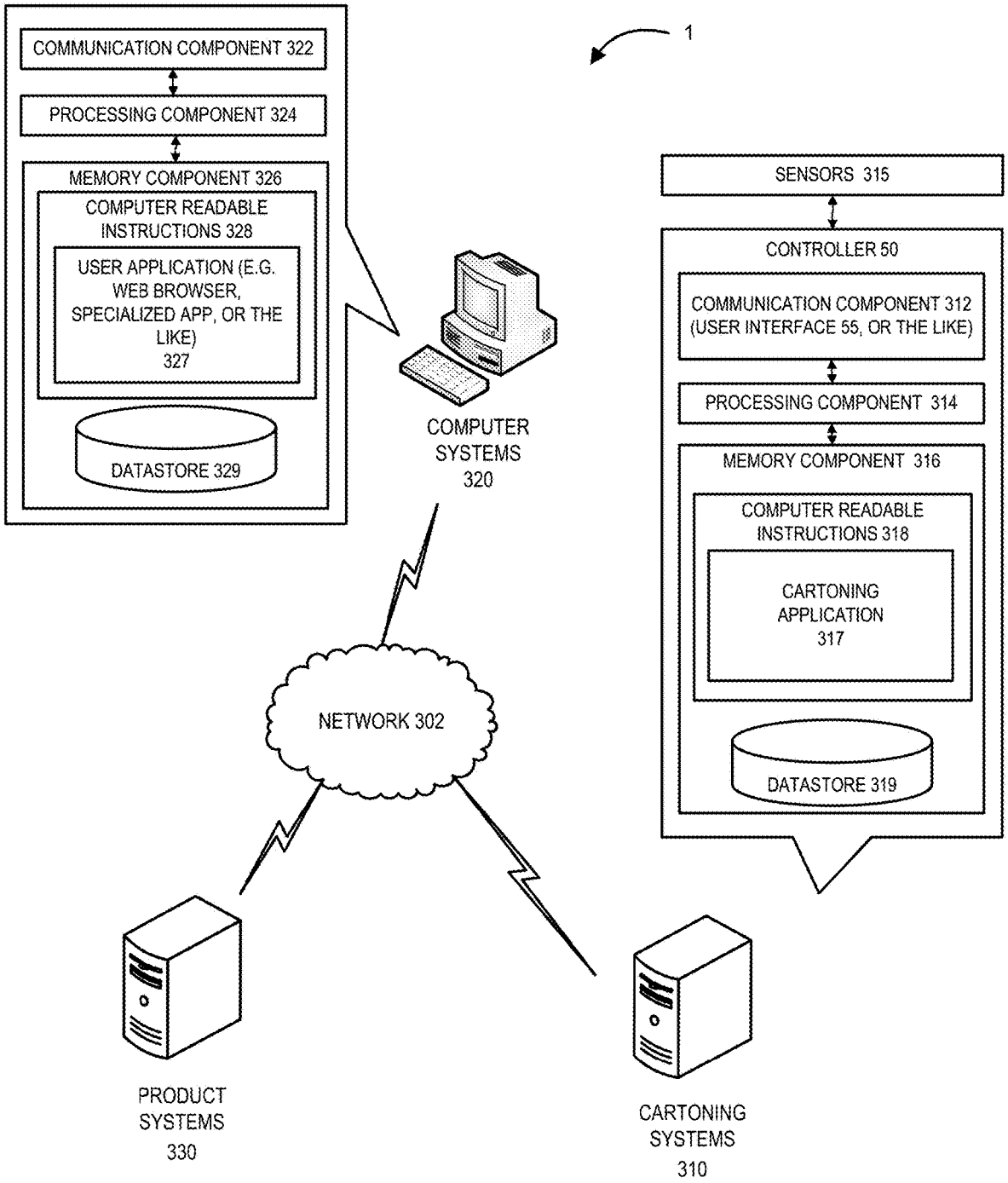
FIG. 16 illustrates a cartoning network system that allows cartoning systems to operate the cartoning machine and/or to communicate with one or more product systems for filling the cartons produced by the cartoning machine, in accordance with embodiments of the present disclosure.

The operation of the cartoning machine 10, including the carton supply station 12, the handling station 14 with the robot 15, the closing station 16 and/or filling stations (if utilized within the cartoning machine 10), are controlled by a programmable controller 50, which may communicate with other systems within a facility. As such, FIG. 16 illustrates a cartoning network system 300, in accordance with embodiments of the present disclosure. As illustrated in FIG. 1, one or more cartoning systems 310 are operatively coupled, via a network 302, to one or more user computer systems 320, one or more product systems 330, and/or one or more other systems (not illustrated). In this way, the cartoning systems 310 operating the cartoning machine 10 may communicate with one or more product systems 330 for filling the cartons produced by the cartoning machine 10. The cartoning systems 310 may communicate with user computer systems 20 to allow the user computer systems 320 to monitor the cartoning machine 10. Moreover, the cartoning systems 310 may communicate with other systems, such as carton supply systems (not illustrated) to determine when magazines 11 require additional cartons for the cartoning machine 10. The communications may occur over a network 302, as will be described in further detail herein.

The network 302 may be a global area network (GAN), such as the Internet, a wide area network (WAN), a local area network (LAN), or any other type of network or combination of networks. The network 302 may provide for wireline, wireless, or a combination of wireline and wireless communication between systems, services, components, and/or devices on the network 2.

As illustrated in FIG. 16, the one or more cartoning systems 310 may comprise a controller 50 that may generally comprise one or more communication components 312, one or more processing components 314, and one or more memory components 316. The one or more processing components 314 are operatively coupled to the one or more communication components 312, and the one or more memory components 316. As used herein, the term "processing component" generally includes circuitry used for implementing the communication and/or logic functions of a particular system. For example, a processing component may include a digital signal processor component, a microprocessor component, and various analog-to-digital converters, digital-to-analog converters, and other support circuits and/or combinations of the foregoing. Control and signal processing functions of the system are allocated between these processing components according to their respective capabilities. The one or more processing components may include functionality to operate one or more software programs based on computer-readable instructions thereof, which may be stored in the one or more memory components.

The controller 50 components, such as the one or more communication components 312, may be operatively coupled to the one or more sensors 315 (e.g., safety sensors, supply sensors, location sensors, or the like as previously discussed herein) located within the cartoning machine 10.

The one or more processing components 314 use the one or more communication components 312 to communicate with the network 302 and other components on the network 302, such as, but not limited to, the components of the one or more user computer systems 320, the one or more product systems 330, and/or the one or more other systems (not illustrated). As such, the one or more communication components 312 generally comprise a wireless transceiver, modem, server, electrical connection, electrical circuit, or other component for communicating with other components on the network 302. The one or more communication components 312 may further include an interface that accepts one or more network interface cards, ports for connection of network components, Universal Serial Bus (USB) connectors, or the like. Moreover, the one or more communication components 312 may include a keypad, keyboard, touch-screen, touchpad, microphone, mouse, joystick, other pointer component, button, soft key, and/or other input/output component(s) for communicating with the users. In some embodiments, as described herein the one or more communication components 312 may comprise a user interface, such as a graphical user interface 55 that allows a user to control and/or monitor the operation of the cartoning machine 10.

As further illustrated in FIG. 16, the one or more cartoning systems 310 comprise computer-readable instructions 318 stored in the one or more memory components 316, which in some embodiments includes the computer-readable instructions 318 of the one or more cartoning applications 17 (e.g., used to operate the cartoning machine 10 and/or the components thereof, or the like). In some embodiments, the one or more memory components 316 include one or more data stores 319 for storing data related to the cartoning machines 10, including, but not limited to, data created, accessed, and/or used by the one or more cartoning systems 310 to operate the one or more cartoning machines 10.

As illustrated in FIG. 16, users may communicate with each other over the network 302 and the cartoning systems 310, the product systems 330, and/or other systems in order to control and/or monitor the various systems remotely. Consequently, the one or more users 4 may be employees, agents, representatives, officers, or the like of an organization operating the facility. The one or more user computer systems 320 may be a desktop, laptop, tablet, mobile device (e.g., smartphone device, or other mobile device), or any other type of computer that generally comprises one or more communication components 322, one or more processing components 324, and one or more memory components 326.

The one or more processing components 324 are operatively coupled to the one or more communication components 322, and the one or more memory components 326. The one or more processing components 324 use the one or more communication components 322 to communicate with the network 302 and other components on the network 302, such as, but not limited to, the one or more cartoning systems 310, the one or more product systems 330, and/or the other systems (not illustrated). As such, the one or more communication components 322 generally comprise a wireless transceiver, modem, server, electrical connection, or other component for communicating with other components on the network 302. The one or more communication components 322 may further include an interface that accepts one or more network interface cards, ports for connection of network components, Universal Serial Bus (USB) connectors and the like. Moreover, the one or more communication components 322 may include a keypad, keyboard, touch-screen, touchpad, microphone, mouse, joystick, other pointer component, button, soft key, and/or other input/output component(s) for communicating with the users. In some embodiments, the one or more communication components 322 may comprise a user interface, such as a graphical user interface that allows a user to remotely control and/or monitor the operation of the cartoning machine 10.

As illustrated in FIG. 16, the one or more user computer systems 320 may have computer-readable instructions 328 stored in the one or more memory components 326, which in some embodiments includes the computer-readable instructions 328 for user applications 327, such as dedicated applications (e.g., apps, applet, or the like), portions of dedicated applications, a web browser or other apps that allow access to applications located on other systems, or the like. In some embodiments, the one or more memory components 326 include one or more data stores 329 for storing data related to the one or more user computer systems 320, including, but not limited to, data created, accessed, and/or used by the one or more user computer systems 320. The user application 327 may use the applications of the one or more cartoning systems 310, the one or more product systems 330, and/or one or more other systems (not illustrated) in order to communicate with other systems on the network 302 and take various actions described herein (e.g., operation, use, monitoring, or the like the cartoning machine 10).

Moreover, as illustrated in FIG. 16, the one or more product systems and/or other systems (not illustrated) have components the same as or similar to the components described with respect to the one or more cartoning systems 310 and the one or more user computer systems 320 (e.g., one or more communication components, one or more processing components, one or more sensors, one or more memory devices with computer-readable instructions of one or more product applications, one or more datastores, or the like). Thus, the one or more product system 330 communicate with the one or more cartoning systems 310, the one or more user computer systems 320, and/or one or more other systems in same or similar way as previously described with respect to the one or more cartoning systems 310, the one or more user computer systems 320, and/or the one or more other systems. The one or more product systems 330 may comprise the systems that operate the machines that produce and/or supply the one or more products to the cartons created by the one or more cartoning machines 10.

As will be appreciated by one of skill in the art in view of this disclosure, embodiments of the invention may be embodied as an apparatus, a system, computer program product, and/or other device, a method, or a combination of the foregoing. Accordingly, embodiments of the invention may take the form of an entirely hardware embodiment, an entirely software embodiment (including firmware, resident software, micro-code, etc.), or an embodiment combining software and hardware aspects that may generally be referred to herein as a "system." Furthermore, embodiments of the invention may take the form of a computer program product comprising a computer-usable storage medium having computer-usable program code/computer-readable instructions embodied in the medium (e.g., a non-transitory medium, or the like).

Any suitable computer-usable or computer-readable medium may be utilized. The computer usable or computer readable medium may be, for example but not limited to, an electronic, magnetic, optical, electromagnetic, infrared, or semiconductor system, apparatus, or device. More specific examples (a non-exhaustive list) of the computer-readable medium would include the following: an electrical connection having one or more wires; a tangible medium such as a portable computer diskette, a hard disk, a random access memory (RAM), a read-only memory (ROM), an erasable programmable read-only memory (EPROM or Flash memory), a compact disc read-only memory (CD-ROM), or other tangible optical or magnetic storage device.

Computer program code/computer-readable instructions for carrying out operations of embodiments of the invention may be written in an object oriented, scripted or unscripted programming language such as Java, Pearl, Python, Smalltalk, C++ or the like. However, the computer program code/computer-readable instructions for carrying out operations of the invention may also be written in conventional procedural programming languages, such as the "C" programming language or similar programming languages.

Several alternative examples have been described and illustrated herein. A person of ordinary skill in the art would appreciate the features of the individual embodiments and the possible combinations and variations of the components. A person of ordinary skill in the art would further appreciate that any of the examples could be provided in combination with the other examples disclosed herein. Additionally, the terms "first," "second," and "third" as used herein are intended for illustrative purposes only and do not limit the embodiments in any way.

As used herein, the singular forms "a", "an" and "the" are intended to include the plural forms as well, unless the context clearly indicates otherwise. It will be further understood that the terms "includes" and/or "including" when used herein, specify the presence of stated features, steps, operations, elements, and/or components, but do not preclude the presence or addition of one or more other features, steps, operations, elements, components, and/or groups thereof.

It will be understood that when an element is referred to as being "engaged," "coupled," or "operatively coupled" (other similar phrase) to another element, the elements can be formed integrally with each other, or may be formed separately and put together. Furthermore, "engaged," "coupled," or "operatively coupled" to can mean the element is directly engaged or operatively coupled to the other element, or intervening elements may be present between the elements. Furthermore, "engaged," "coupled," or "operatively coupled" may mean that the elements are detachable from each other, or that they are permanently coupled together.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and should not be interpreted in an idealized or overly formal sense unless expressly so defined herein. Certain terminology is used herein for convenience only and is not to be taken as a limitation on the invention. For example, words such as top, bottom, front, rear, side, upper, lower, left, right, horizontal, vertical, upward, and downward merely describe the configuration shown in the figures. The referenced components may be oriented in an orientation other than that shown in the drawings and the terminology, therefore, should be understood as encompassing such variations unless specified otherwise. All structural and functional equivalents to the elements of the various aspects described throughout the disclosure that are known or later come to be known to those of ordinary skill in the art are expressly incorporated herein by reference and are intended to be encompassed by the claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, the subject matter lies in less than all features of a single disclosed configuration or operation. The claims are hereby incorporated into the detailed description, with each claim standing on its own as a separately claimed subject matter.

What is claimed is:

1. A cartoning apparatus comprising:

a handling station comprising a robot, wherein the robot comprises:

a first arm having two ends;

a second arm operatively coupled to one end of the first arm; and a grip hand operatively coupled to another end of the first arm;

wherein the first arm rotates relative to the second arm;

a carton supply station comprising:

a rotating support;

a plurality of magazines operatively coupled to the rotating support for holding cartons, the plurality of magazines comprising at least a first magazine configured to hold a plurality of first cartons and at least a second magazine configured to hold a plurality of second cartons, wherein the plurality of first cartons and the plurality of second cartons have at least one different attribute, and wherein the plurality of magazines are movable with respect to the robot by rotating the rotating support;

a carton feeder mechanism and pick-up position sensor, wherein the carton feeder mechanism moves a carton to a pre-determined pick-up position based on feedback from the pick-up position sensor;

a filling station or a closing station arranged adjacent to the handling station, wherein the filling station fills the carton with one or more products, and wherein the closing station folds one or more flaps of the carton; and a controller operatively coupled to the robot and the carton supply station, and wherein the controller is configured to:

identify one or more operating parameters for the cartoning apparatus including at least a sequence of carton use for the plurality of magazines based on the at least one different attribute;

communicate with the carton supply station to selectively rotate the rotating support to move the plurality of magazines based on at least the sequence of carton use; and communicate with the robot to pick the cartons from the pre-determined pick-up position from the plurality of magazines using the grip hand based on at least the sequence of carton use and transporting the cartons to the filling station or the closing station;

wherein as the robot is transporting a first carton after pick-up from the first magazine in the carton supply station, or after the robot has transported the first carton to the filling station or the closing station and the robot is moving to select a second carton from the second magazine, the carton supply station rotates the rotating support and the carton feeder mechanism moves the second carton to the pre-determined pick-up position for picking by the robot.

2. The cartoning apparatus of claim 1, wherein the cartons held in the plurality of magazines comprise a plurality of carton blanks.

3. The cartoning apparatus of claim 1, wherein the cartons held in the plurality of magazines comprise a plurality of pre-formed cartons.

4. The cartoning apparatus of claim 1, wherein the grip hand rotates with respect to the first arm.

5. The cartoning apparatus of claim 1, wherein the carton feeder mechanism is configured to move the carton in the first magazine to the pre-determined pick-up position for the robot to pick the carton from the first magazine.

6. The cartoning apparatus of claim 5, wherein the carton feeder mechanism comprises:

an elevator mechanism, wherein the elevator mechanism elevates the plurality of first cartons in the first magazine such that the carton moved to the pre-determined pick-up position is an upper most carton in the first magazine.

7. The cartoning apparatus of claim 1, wherein the grip hand comprises:

at least one first suction component on a first suction mount; and at least one second suction component on a second suction mount;

wherein the first suction mount and the second suction mount rotate with respect to each other;

wherein the at least one first suction component and the at least one second suction component are located in the same plane to pick up the carton; and wherein the at least one first suction component and the at least one second suction component are located in a different plane to open the carton.

8. The cartoning apparatus of claim 1, wherein the robot is configured to open the carton for receipt of the one or more products.

9. The cartoning apparatus of claim 8, wherein the carton is a carton blank and the robot comprises:

a first engaging component; and a second engaging component;

wherein the first engaging component engages the carton blank on a first portion and the second engaging component engages the carton blank on a second portion, and wherein the first engaging component moves with respect to the second engaging component to open the carton along a fold line between the first portion and the second portion.

10. The cartoning apparatus of claim 9, wherein the handling station or the carton supply station further comprises:

a projection component, wherein the projection component is configured to be positioned adjacent to the fold line to aid in folding the carton around the fold line when the first engaging component moves with respect to the second engaging component.

11. The cartoning apparatus of claim 1, wherein the closing station comprises:

a flap-folding station for folding one or more flap of the carton; and a pressing station for applying a tape and pressing the one or more flaps against the tape.

12. The cartoning apparatus of claim 1, wherein the different attribute is carton size, and wherein the cartoning apparatus further comprises:

a product supply station, wherein the first carton is utilized from the first magazine when a first product amount is selected for packaging, and wherein the second carton is utilized from the second magazine when a second product amount is selected.

13. The cartoning apparatus of claim 1, further comprising:

two or more product supply stations, wherein the first carton is utilized from the first magazine when a first product from a first product supply is selected for packaging, and wherein the second carton is utilized from the second magazine when a second product from a second product supply is selected.

14. The cartoning apparatus of claim 1; further comprising:

a physical boundary between the handling station and the carton supply station separating the robot of the handling station from one or more of the plurality of magazines of the rotating support.

15. A method of supplying a carton using a cartoning apparatus, wherein the cartoning apparatus comprises a handling station comprising a robot, a carton supply station comprising a rotating support and a plurality of magazines operatively coupled to the rotating support for holding cartons, a carton feeder mechanism and a pick-up position sensor, a filling station or a closing station arranged adjacent to the handling station, wherein the filling station fills the carton with one or more products, and wherein the closing station folds one or more flaps of the carton, and a controller operatively coupled to the robot and the carton supply station, wherein the robot comprises a first arm having two ends, a second arm operatively coupled to one end of the first arm, and a grip hand operatively coupled to another end of the first arm, wherein the first arm rotates relative to the second arm, wherein the plurality of magazines comprise a first magazine adjacent to the robot and a second magazine away from the robot, wherein the first magazine is configured to hold a plurality of first cartons and the second magazine is configured to hold a plurality of second cartons, wherein the plurality of first cartons and the plurality of second cartons have at least one different attribute, and wherein the plurality of magazines are movable with respect to the robot by rotating the rotating support, the method comprising:

identifying, by the controller, one or more operating parameters for the cartoning apparatus including at least a sequence of carton use for the plurality of magazines based on the at least one different attribute;

communicating, by the controller, with the carton supply station to selectively rotate the rotating support to move the plurality of magazines based on at least the sequence of carton use;

communicating, by the controller, with the carton feeder mechanism to move a carton in a magazine to a pre-determined pick-up position based on feedback from the pick-up position sensor; and communicating, by the controller, with the robot to pick the carton from the pre-determined pick-up position of the magazine using the grip hand and transferring the carton to the closing station;

wherein as the robot is transporting a first carton after pick-up from the first magazine in the carton supply station, or after the robot has transported the first carton to the filling station or the closing station and the robot is moving to select a second carton from the second magazine, the carton supply station rotates the rotating support and the carton feeder mechanism moves the second carton to the pre-determined pick-up position for picking by the robot.

16. The method of claim 15, wherein the cartons held in the plurality of magazines comprise a plurality of carton blanks or a plurality of pre-formed cartons.

17. The method of claim 15, wherein the grip hand rotates with respect to the first arm.

18. The method of claim 15, wherein the grip hand comprises:

at least one first suction component on a first suction mount; and at least one second suction component on a second suction mount;

wherein the first suction mount and the second suction mount rotate with respect to each other;

wherein the at least one first suction component and the at least one second suction component are located in the same plane to pick up the carton; and wherein the at least one first suction component and the at least one second suction component are located in a different plane to open the carton.

* * * * *